US006997345B2

(12) United States Patent
Mitchell et al.

(10) Patent No.: US 6,997,345 B2
(45) Date of Patent: Feb. 14, 2006

(54) DISPENSER FOR SHEET MATERIAL

(75) Inventors: Joseph Mitchell, Alpharetta, GA (US); Debra N. Welchel, Woodstock, GA (US); Herb F. Velazquez, Neenah, WI (US); Tim J. Morton, Chicago, IL (US); Joel G. Delman, Chicago, IL (US); Melanie L. Andres, Chicago, IL (US); John B. Freese, Evanston, IL (US); Donna Ann Piacenza, Chicago, IL (US); Leslie T. Long, Appleton, WI (US); Richard H. D. Bullock, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 190 days.

(21) Appl. No.: 10/439,426

(22) Filed: May 16, 2003

(65) Prior Publication Data

US 2004/0245267 A1 Dec. 9, 2004

(51) Int. Cl.
*B65G 59/00* (2006.01)

(52) U.S. Cl. ..... 221/283; 242/595

(58) Field of Classification Search ..... 221/45, 221/63, 282, 283; 242/595, 598.5, 594.1; 248/214, 311.2, 213.2; 206/494, 806, 409, 206/812, 233

See application file for complete search history.

(56) References Cited

U.S. PATENT DOCUMENTS

| | | | |
|---|---|---|---|
| 2,122,048 | A | 6/1938 | Shapiro |
| 2,765,909 | A | 10/1956 | Graham |
| RE24,906 | E | 12/1960 | Ulrich |
| 3,301,746 | A | 1/1967 | Sanford et al. |
| 3,322,617 | A | 5/1967 | Osborne |
| 3,612,264 | A | 10/1971 | Trunick |
| 3,824,953 | A | 7/1974 | Boone |
| 3,836,044 | A | 9/1974 | Tilp et al. |
| 3,837,595 | A | 9/1974 | Boone |
| 3,857,731 | A | 12/1974 | Merrill, Jr. et al. |
| 3,921,802 | A | 11/1975 | Thompson |
| 3,986,479 | A | 10/1976 | Bonk |
| 3,995,582 | A | 12/1976 | Douglas |
| 4,106,616 | A | 8/1978 | Boone |
| 4,106,617 | A | 8/1978 | Boone |
| 4,190,321 | A | 2/1980 | Dorer et al. |
| 4,235,333 | A | 11/1980 | Boone |
| 4,610,357 | A | 9/1986 | Nakamura |
| 4,620,502 | A | 11/1986 | Kimble |
| 4,638,921 | A | 1/1987 | Sigl et al. |
| 4,651,874 | A | 3/1987 | Nakamura |

(Continued)

FOREIGN PATENT DOCUMENTS

| | | |
|---|---|---|
| CA | 2305110 | 10/2001 |

(Continued)

*Primary Examiner*—Kenneth Noland
(74) *Attorney, Agent, or Firm*—Sue C. Watson

(57) ABSTRACT

A dispenser is provided which is adapted for dispensing from a table top and it is convertible to dispensing from a conventional rolled product fixture. The dispenser includes a housing having a compartment configured to hold sheets. The housing also has a dispensing opening. The housing is configured to be positioned on a table top for dispensing sheets therefrom, and the housing includes a sling which permits the housing to be coupled to a conventional rolled product fixture. The sling is masked when the dispenser is positioned for dispensing from a table top. The sling is readily releasable to permit the housing to be coupled to a fixture in a bathroom.

37 Claims, 12 Drawing Sheets

U.S. PATENT DOCUMENTS 4,653,250 A 3/1987 Nakamura
4,739,879 A * 4/1988 Nakamura ..... 206/205
4,741,944 A 5/1988 Jackson et al.
4,834,316 A 5/1989 DeLorean
4,865,221 A 9/1989 Jackson et al.
4,913,312 A 4/1990 Boutin
5,048,589 A 9/1991 Cook et al.
5,194,299 A 3/1993 Fry
5,265,758 A 11/1993 Saint Criq et al.
5,311,986 A * 5/1994 Putz ..... 206/233
5,399,412 A 3/1995 Sudall et al.
5,409,181 A 4/1995 Patrick
5,439,521 A 8/1995 Rao
5,607,551 A 3/1997 Farrington et al.
5,618,008 A 4/1997 Dearwester et al.
5,620,148 A 4/1997 Mitchell
5,629,081 A 5/1997 Richards et al.
5,656,361 A 8/1997 Vogt et al.
5,660,636 A 8/1997 Shangold et al.
5,672,248 A 9/1997 Wendt et al.
5,765,717 A 6/1998 Gottselig
5,897,074 A 4/1999 Marino
5,950,960 A * 9/1999 Marino ..... 242/594.5
5,951,762 A 9/1999 Shangold et al.
5,964,351 A 10/1999 Zander
6,047,920 A 4/2000 Dearwester et al.
6,056,235 A 5/2000 Brozinsky
6,098,836 A 8/2000 Gottselig
6,098,919 A 8/2000 Lewis
6,170,698 B1 1/2001 Phelps et al.
6,230,929 B1 5/2001 Phelps et al.
6,328,252 B1 12/2001 Neveu et al.
6,346,153 B1 2/2002 Lake et al.
6,382,552 B1 5/2002 Paul et al.
6,439,386 B1 8/2002 Sauer et al.
2002/0063136 A1 5/2002 Sauer et al.
2002/0092789 A1 7/2002 Sauer et al.
2003/0075551 A1 4/2003 Dailey, III
2003/0192903 A1 10/2003 Sauer et al.

FOREIGN PATENT DOCUMENTS

EP 0459110 12/1991
EP 0568987 7/1997
GB 2270901 3/1994
GB 2270901 A * 3/1994
WO WO 01/76439 10/2001

* cited by examiner

DISPENSER FOR SHEET MATERIAL

BACKGROUND OF THE INVENTION

The use of single sheets provided as interfolded sheets for bath tissue has been widely accepted. Such single interfolded sheets often provide less waste than traditional rolled bath tissue. Similarly, the use of premoistened or "wet" sheets has gained wide acceptance for a variety of uses, particularly premoistened bathroom applications. The dry sheets and premoistened sheets are generally formed from an absorbent material such as a paper or a polymeric web, or combinations thereof, and may contain a disinfectant, medicant, deodorant, anti-microbial, anti-bacterial, cleansing agent, and so forth, in one or more combinations, on a dry sheet, or in a "wet" formulation on a premoistened sheet. Premoistened sheets are generally stored and dispensed from a sealable container to prevent the sheets from drying out.

Various dispenser designs for dry and/or premoistened sheets have been used with existing bathroom fixtures, such as fixtures for conventional rolled products. These separate or combined dispensers are often cumbersome and bulky, and they are problematic with regard to space and mounting considerations. Refilling one or both dispensers can also be difficult.

Accordingly, it would be desirable to provide a dispenser capable of dispensing dry and/or premoistened sheets, such as facial tissue, and so forth, from a table top. Such a dispenser would quickly and easily convert into a dispenser configured to couple to a conventional rolled product fixture and dispense sheets, such as toilet tissue, therefrom.

Definitions

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component.

Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "couple" includes, but is not limited to, joining, connecting, fastening, linking, or associating two things integrally or interstitially together.

These terms may be defined with additional language in the remaining portions of the specification.

SUMMARY OF THE INVENTION

In response to the difficulties and problems discussed above, a dispenser is provided which is adapted for dispensing from a table top and it is convertible to dispensing from a conventional rolled product fixture. The dispenser includes a housing having a compartment configured to hold sheets. The housing also has a dispensing opening. The housing is configured to be positioned on a table top for dispensing sheets therefrom, and the housing includes a sling which permits the housing to be coupled to a conventional rolled product fixture. The sling is masked when the dispenser is positioned for dispensing from a table top. The sling is readily releasable to permit the housing to be coupled to a fixture in a bathroom.

DETAILED DESCRIPTION

Figure 1:
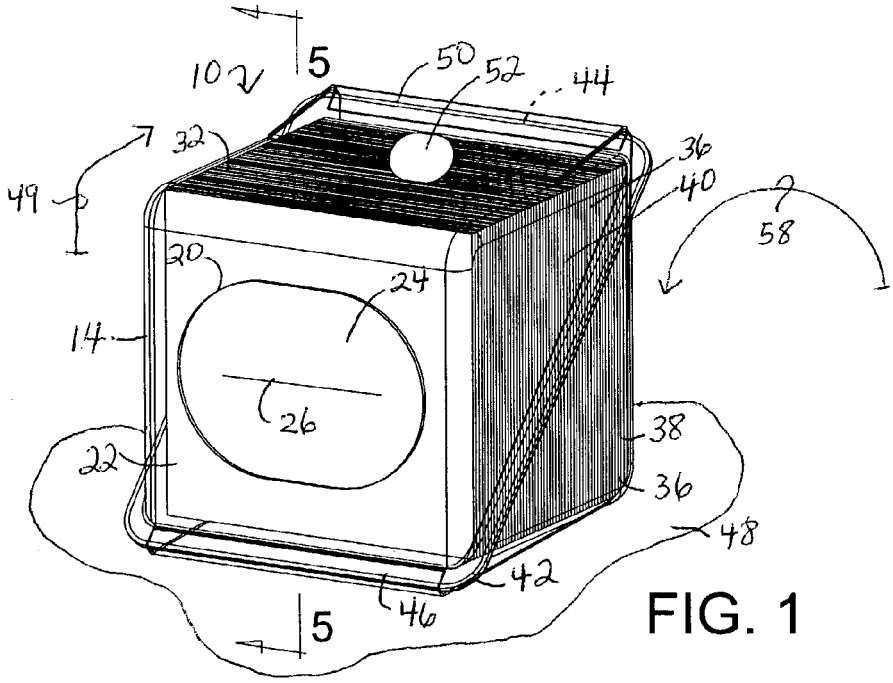
FIG. 1 is a perspective view of an embodiment of the dispenser of the present invention, showing the dispenser in its dispensing position on a substantially horizontal surface for dispensing dry sheets therefrom.

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Referring to the figures in general, a dispenser is provided for storing and dispensing sheets. It should be appreciated that the present invention is not limited to any particular type of sheets. The dispenser, however, is well suited for dispensing, by way of non-limiting example, individual stacked sheets and/or interfolded sheets, as generally illustrated in the figures. Non-limiting examples of dry sheets are disclosed in U.S. Pat. No. 3,301,746 to Sanford et al., U.S. Pat. No. 3,322,617 to Osborne, U.S. Pat. No. 5,048,589 to Cook et al., U.S. Pat. No. 5,399,412 to Sudall et al., U.S. Pat. No. 5,607,551 to Farrington et al., and U.S. Pat. No. 5,672,248 to Wendt et al., all of which are incorporated by reference herein in their entirety. Non-limiting examples of premoistened sheets are disclosed in U.S. Pat. Nos. 4,741,944 and 4,865,221, both to Jackson et. al., U.S. Pat. No. 5,629,081 to Richards et al., U.S. Pat. No. 5,656,361 to Vogt et al., and U.S. Pat. No. 5,964,351 to Zander, all of which are incorporated by reference in there entirety herein. Such stack configurations for dry sheets, such as toilet tissue and/or premoistened sheets are well known to those of ordinary skill in the art and need not be described in great detail herein.

Figure 2:
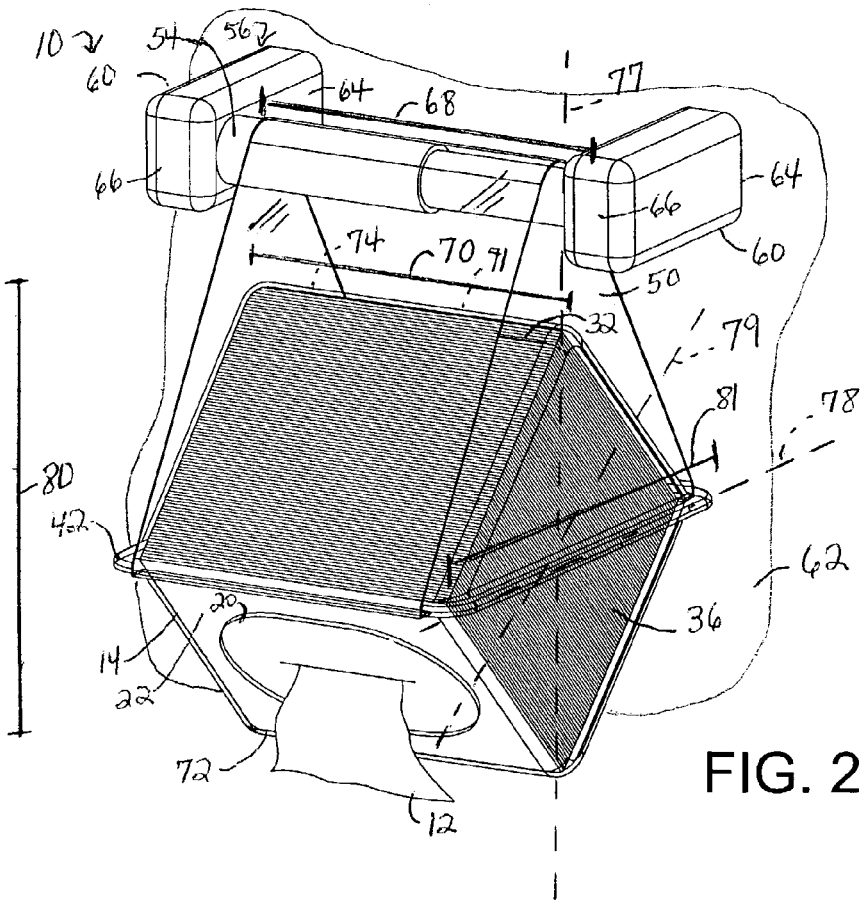
FIG. 2 is perspective view of the dispenser of FIG. 1, but showing the dispenser in its dispensing position for dispensing dry sheets when hung by its sling from a roll mount of a conventional rolled product fixture.
Figure 3:
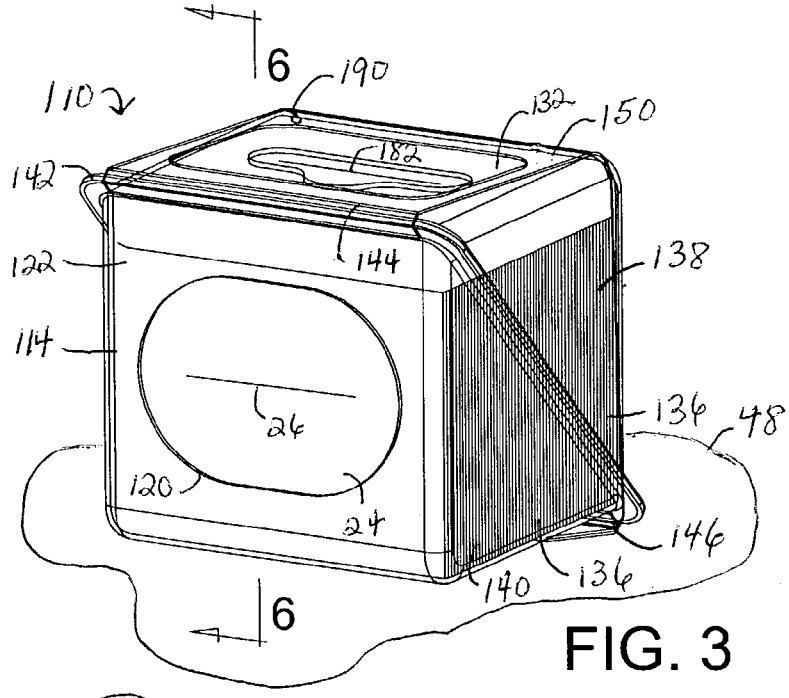
FIG. 3 is another embodiment of a dispenser of the present invention, showing the dispenser in its dispensing position on a substantially horizontal surface for dispensing either dry sheets or premoistened sheets therefrom.
Figure 4:
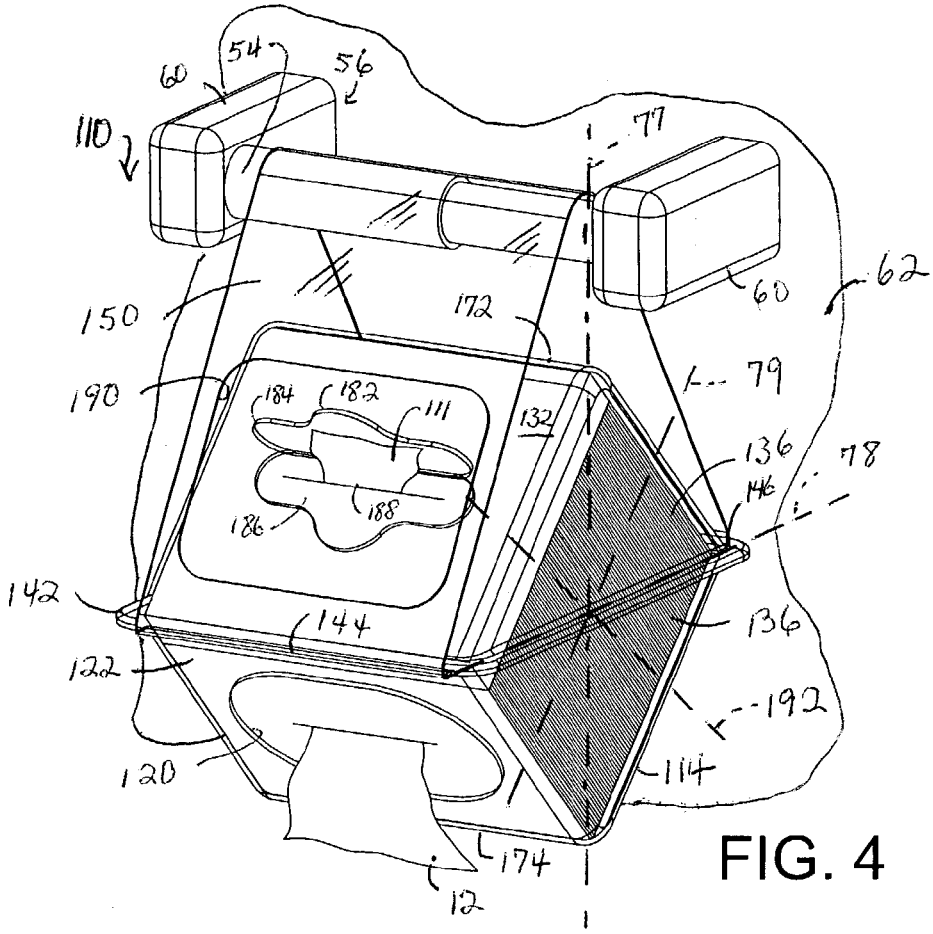
FIG. 4 is a perspective view of the dispenser of FIG. 3, but showing the dispenser in its dispensing position for dispensing dry sheets and premoistened sheets when hung by its sling from a roll mount of a conventional rolled product fixture.
Figure 5:
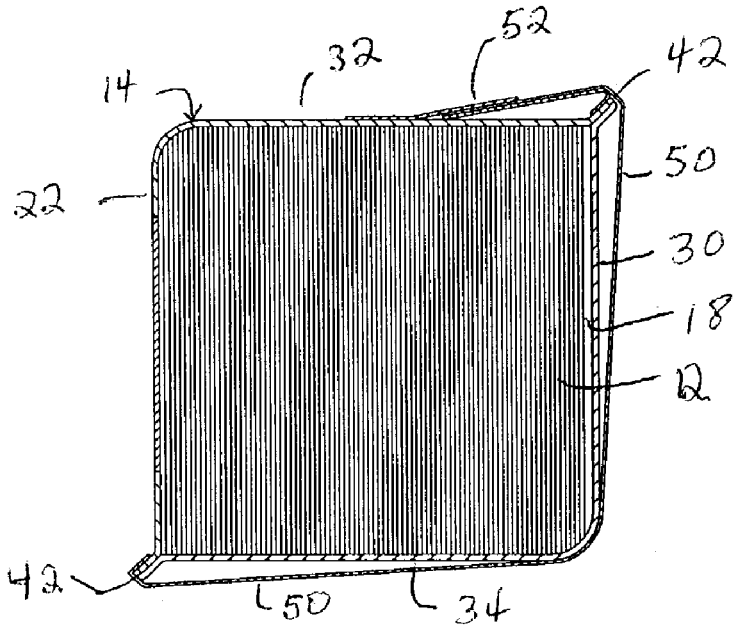
FIG. 5 is a sectional view of FIG. 1 taken along line 5—5.
Figure 6:
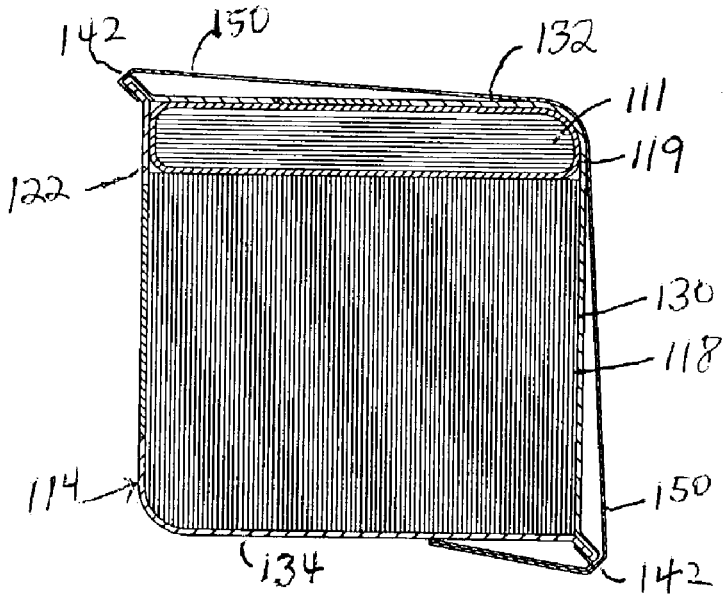
FIG. 6 is a sectional view of FIG. 3 taken along line 6—6.

The dispenser shown in FIGS. 1, 2 and 5, discloses a dispenser containing sheets. The dispenser may be used to dispense sheets from a table top for use as facial tissue sheets. The dispenser also has a sling which permits it to be releasably coupled to a conventional rolled product fixture; the dispenser extends diagonally therefrom to provide dry sheets for bath or toilet tissue. The dispenser shown in FIGS. 3, 4 and 6 is similar to the previous dispenser, but dispenses premoistened sheets as well as dry sheets.

Turning now to FIGS. 1, 2 and 5, a dispenser 10 according to the invention is provided for desirably, but not by way of limitation, dispensing dry sheets 12. In addition, the dry sheets 12 are desirably interfolded, stacked, and/or festooned, with or without perforations, and so forth.

The dispenser 10 includes a housing 14 which has a compartment 18 in which dry sheets 12 are stored and dispensed therefrom. A dispensing opening 20 is defined in the housing 14 to permit access to the compartment 18 and the dry sheets 12 therein. The dispensing opening 20 desirably is provided by way of non-limiting example in a front wall 22. One or more dispensing openings may be provided, however, in any wall, structure, and/or combination thereof in any embodiment herein of the housing to permit dispensing of any sheet(s) shown and/or described herein. It will be appreciated that the dispensing opening of any embodiment herein may take any suitable shape and configuration. Any dispensing opening shown and/or described herein may be covered, for example, but not by way of limitation, by a plastic film 24 having a slit 26 to provide access to the sheets, and so forth. In another alternative, the dispensing opening may be formed from perforated portions that, when removed, provide the opening (not shown), and so forth.

The housing 14 includes front and back walls 22, 30 and upper and lower ends 32, 34. Sidewalls 36 cooperate with the walls 22, 30 and ends 32, 34 to provide the housing 14. The housing 14 is formed, however, such that the lower end 34 and back wall 30, along with a first triangular portion 38 of the adjacent sidewalls 36, provide half of the housing 14. The front wall 22, the upper end 32, and a second triangular portion 40 of the adjacent sidewalls 36 provide the other half of the housing 14. A separation is provided therebetween which is further defined by a perimeter flange edge 42 provide by each half of the housing 14 which extends outward about the housing 14 that is formed, coupled and/or sealed together. The perimeter flange edges 42 extend about the housing 14 from the junction 44 of the upper end 32 and the back wall 30, across each side wall 36 to the junction 46 of the front wall 22 and the lower end 34. The perimeter flange edges 42 separate the housing 14 at the sidewalls 36, creating the first triangular portions 38 and the second triangular portions 40, each of which may have right angles formed therein. Desirably, but not by way of limitation, the housing 14 may be formed to generally conform to a certain amount of dry sheets 12 provided in the housing 14. In the present embodiment, the dry sheets 12 as a group have a generally polygonal shape. Similarly, by way of non-limiting example, the housing 14 has a polygonal shape as well.

The dispenser 10 is used to dispense dry sheets 12 from a generally horizontal surface 48, such as, for example, a table top, and so forth. When the dispenser 10 is positioned on such a horizontal surface 48, the structure, namely the wall or end having the dispensing opening 20 therein, such as the front wall 22, is desirably disposed in a superior or higher position. Structures of the dispenser 10 which do not have a dispensing opening therein are desirably positioned in an inferior or lower position. As shown in FIG. 1, the front wall 22 which has the dispensing opening 20 may be positioned such that the dry sheets may be withdrawn from the side of the dispenser 10. However, the dispenser 10 may be rotated in a direction 49 about 90 degrees such that the front wall 22 having the dispensing opening 20 therein is now the top or uppermost structure of the dispenser 10 (not shown). It will be appreciated that any position may be used to dispense dry sheets 12, such as tissue sheets used as facial tissue, and so forth, from a horizontal surface 48 such as a table top. However, as often occurs in a bathroom, it is desirable to have a dispenser 10 which is suitable for dispensing dry sheets 12 for use as bath or toilet tissue. The dispenser 10 easily adapts to this task, converting from a table top dispenser to a dispenser which couples to a conventional rolled product fixture for dispensing sheets for use as bath or toilet tissue.

As shown in FIG. 1, the dispenser 10 desirably includes a sling 50 which is attached to a portion of the housing 14, in this instance, the perimeter edge 42 at junction 44 and the perimeter edge at junction 46. The sling 50 is overlapped and positioned against the housing 14 and held in place by a removable adhesive seal 52 when the dispenser 10 is positioned for use on a horizontal surface 48 for dispensing dry sheets 12 as facial tissue, and so forth. This masks the sling 50 against the housing 14 and effectively hides the purpose of the sling 50. When the dispenser 10 is desired for use as a dispenser for toilet tissue, the seal 52 is removed, and the sling 50 is extended and ready to be positioned on a roll mount 54 of a conventional rolled product fixture 56.

The dispenser 10 shown in FIG. 1 is rotated in a direction 58 and the sling 50 is positioned over a roll mount 54 which is releasably coupled to the fixture 56, as illustrated in FIG. 2. Such a fixture 56 has at least a side support arms 60 mounted to and extending transversely from a generally vertical support surface 62. Alternatively, the support arms 60 are coupled to a base or back member (not shown). As shown in FIG. 2, each of the side support arms 60 extends from a coupled end 64 to a free end 66 of the support arm 60, which often has a recess therein (not shown). In addition, the support arms 60 have a width dimension 68 which extends between the support arms 60. Typically, a roll mount 54 extends across this width dimension 68 to releasably couple to the support arms 60. The roll mount 54 typically includes a protruding member on each end (not shown). The protruding member is desirably releasably positioned in the recess of the support arm 60 to suspend the roll mount 54 between the support arms 60. The roll mount 54 in the present embodiment, for example, is a conventional spindle.

The roll mount 54 is positioned under the sling so that the dispenser 10 may be releasably coupled to the roll mount 54 and the fixture 56. As used herein, the term "roll mount" includes a spindle, and also includes a pair of prongs mounted on each support arm in a confronting relationship, such that may be used with a coreless bath tissue roll, such as, by way of example and not limitation, the one illustrated and described in detail in U.S. Pat. No. 5,620,148 to J. Mitchell, which is hereby incorporated by reference in its entirety herein.

In the embodiments illustrated herein, the width dimension 68 between the support arms 60 also provides a desired and aesthetic proportion for a width dimension 70 of the upper end 71 of the housing 14 and the sling 50. The width dimension 68 between the support arms 60 is typically in a range of about 6.0 inches to about 4.0 inches.

Therefore, the width dimension 70 of the upper end 71 of the housing 14 is desirably in a range of about 5.5 inches to about 4.7 inches. Even more desirably, the width dimension 70 is in a range of about 5.25 inches to about 4.6 inches. Yet even more desirably, the width dimension 70 is in a range of about 5.25 inches to about 4.5 inches.

When the housing 14 is suspended from the roll mount 54, the housing is positioned diagonally with respect to the sling 50 and the roll mount 54. The perimeter edge 42 of the housing 12 is positioned perpendicularly with respect to the generally vertical support surface 62 upon which the fixture 56 is mounted. In this position, the front wall 22 and the dispensing opening 20 therein is at an oblique lower or inferior position, and the upper end 32 is positioned at an oblique lower position adjacent the vertical support surface 62. At the junction of the front wall 22 and upper end 32 which may be positioned at about a 90 degree angles relative to each other, a rounded lower edge 72 is the lowest structure of the housing 14. In addition, when the dispenser 10 is suspended from the roll mount 54, the lower end 34 is positioned at an oblique higher position facing a user, while the back wall 30 is positioned at an oblique higher position adjacent the vertical support surface 62. At the junction 44 of the lower end 34 and the back wall 30 which may be positioned at about a 90 degree angle relative to each other, a rounded upper edge 74 which, other than the sling 50, provides the highest structure of the housing 14, is provided.

A first axis 77 is positioned vertically through the roll mount 54, the sling 50, the upper vertex or upper rounded edge 74 and the lower vertex or the lower rounded edge 72 and is postioned substantially vertically therethrough. The first axis 77 is also positioned substantially parallel to the generally vertical support surface 62. A second axis 78 is positioned through the junctions 44, 46 which provides the greatest depth of the housing 14; the second axis is desirably substantially perpendicular to the first axis 77 and the vertical support surface 62. The dry sheets 12 in the dispensing position on a fixture 56 are desirably positioned at an oblique angle on a third axis 79 relative generally to the vertical support surface 62, the first axis 77 and the second axis 78 as illustrated in FIG. 2. This is unlike the dispensing position of the dry sheets 12 from a horizontal surface 48, where the dry sheets 12 are dispensed at either a perpendicular angle relative to the horizontal support surface 48, or are parallel to the horizontal support surface 48 when the housing 12 is rotated in the direction 49, as previously described herein.

In addition, the housing 14 desirably has a length dimension 80 which extends from the upper rounded edge 74 to the lower rounded edge 72. The housing 14 also has a depth dimension 81 which extends from junction 44 to junction 46.

Any portion of any housing shown and/or described herein may include an opening which, if the housing is opaque, reveals the amount of tissue contained in the compartment (not shown). Such an opening provides an indication of whether there is sufficient tissue in the compartment, or whether a refill may be needed. It will be appreciated that when the housing is substantially clear or tinted, the dry sheets are visible to a user and no opening may be needed.

The housing 14 may desirably be non-refillable, and when the dry sheets 12 are removed, the dispenser 10 is disposed of. However, the housing may be refillable. It refillable, the housing will open along the junction of the edges (not shown). At least a portion of the edges may be connected by hinges, such as living hinges, fasteners, latches, and so forth, to permit access and closure to the compartment.

Any housing herein may be formed from any conventional material, such as, but not by way of limitation, metal, plastic, wood, fabric, fiber, and any combination thereof, and so forth. Any housing herein may also be provided from a relatively inexpensive cardboard, paper, paperboard, plastic, polymer film, cellophane, any combination thereof, and so forth. Any housing herein may be provided in any shape or configuration, and the present embodiments are provided as a non-limiting example thereof.

If the dispenser 10 permits refilling, a plurality of dry sheets 12 are disposed in the compartment 18 of the housing 14. In this instance, the dry sheets 12 may be provided in a cartridge of sheets (not shown). Such a cartridge is formed about at least a portion of the dry sheets to couple a plurality of dry sheets together. The cartridge may be a band, or may provide a housing (not shown). In this situation, an opening is provided in at least one surface of the cartridge which desirably aligns with a dispensing opening in the housing, to permit dispensing of the sheets therefrom.

In another embodiment of the invention, as illustrated in FIGS. 3, 4 and 6, the dispenser 110 and housing 114 are very similar to the dispenser 10 and the housing 14 shown in FIGS. 1, 2 and 5, and previously described in detail herein. The dispenser 110, however, is adapted to provide premoistened sheets 111 as well as dry sheets 12 from a single housing 114. The compartment 118 contains a plurality of dry sheets 12. The compartment 118 also includes a container 119 of premoistened sheets 111 as well. The container 119 of premoistened sheets 111, as illustrated in FIG. 6, may be provided as a separate container 119. Alternatively, however, the container 119 of premoistened sheets 111 may be provided as a portion of a cartridge which includes dry sheets 12 (not shown).

The housing 110, similar to the housing 10, includes front and back walls 122, 130 and upper and lower ends 132, 134. Sidewalls 136 cooperate with the walls 122, 130 and ends 132, 134 to provide closure to the housing 114. The housing 114 is formed, however, such that the front wall 122 and lower end 134, along with a portion of the adjacent sidewalls 136, provide half of the housing 114. The upper end 132, the back wall 130, and a portion of the adjacent sidewalls 136 provide the other half of the housing 114. A separation is provided therebetween which is further defined by a perimeter flange edge 142 provided by each half of the housing 114 that is formed, coupled and/or sealed together. The perimeter flange edges 142 extend about the housing 114 from the junction 144 of the front wall 128 and the upper end 132, across each sidewall 136 to the junction 146 of the back wall 130 and the lower end 134. The perimeter flanged edges 142 define the separation of the housing 114 into two halves and create two first and second triangular portions 138, 140 of each sidewall 136. Desirably, but not by way of limitation, the housing 114 may be formed to generally conform to a certain amount of dry sheets 12 and premoistened sheets 111. In the present embodiment, the dry sheets 12 and the container 119 of premoistened sheets 111 may together have a generally polygonal shape.

The premoistened sheets 111 are dispensed from the container 119 from openings (not shown) in the container 119 and through a dispensing opening (not shown) in the housing 114. The dry sheets 12 are dispensed from the dispensing opening 120 in the front wall 122 of the housing 114, as illustrated in FIG. 4.

As shown in FIGS. 3 and 4, a resealable cover 182 may be positioned over the dispensing opening (not shown) in the housing 114 which is aligned with the opening (not shown) in the container 119 of premoistened sheets 111. The premoistened sheets 111 are then accessed through the resealable cover 182 to permit dispensing of the premoistened sheets 111 from the dispenser 110. Alternatively, or, in addition thereto, the container 119 may also include a resealable cover 182 which is aligned with the dispensing opening of the housing 114 to permit access to the premoistened sheets 119 as well (not shown).

The resealable cover 182 is used to maintain the moisture conditions within the container 119 and to prevent undesired drying out of the premoistened sheets 111. In a non-limiting example of one possible resealable cover 182, FIGS. 3 and 4 disclose a resealabe cover 182 which includes an upper flap 184 which is coupled to a portion of a lower flap 186, which has an opening or slit 188 opening therein, through which the premoistened sheets 111 are withdrawn. The upper flap 184 releasably engages the lower flap 186 to provide a releasable closure to the housing 114 and the container 119. Such releasable and resealable features between the upper and lower flaps 184, 186 is provided, by way of non-limiting example, an adhesive, such as a pressure sensitive adhesive, a cohesive adhesive, such as a latex or other natural rubber material, and so forth. Other resealable mechanisms, such as, by way of non-limiting example, snap-fit, hinged cover and lid, and so forth are known and may be used; any resealable mechanism known in the art may be used with any dispensing opening in the housing and/or any opening in the container.

As illustrated in FIG. 6, the housing 114 desirably is an integral unit such that one compartment contains the dry sheets 12 and the container 119 of premoistened sheets 111. However, alternatively, the housing 114 may include first and second compartments formed separately such that one compartment holds dry sheets and another compartment holds the container of premoistened sheets (not shown). Such compartments may be delineated by separate cartridges or containers, or, by way of non-limiting example, the housing may have at least a portion of an inner wall (not shown) in which to provide first and second compartments (not shown).

The premoistened sheets 111 may be encased in a liquid impermeable film, and this film may provide a portion, or all, of the container 119 as shown in FIG. 6. In a further example, the container 119 may be formed from at least one other material, and the container 119 may be lined with the film (not shown).

When the dispenser 110 is used to dispense dry sheets 12 and premoistened sheets 111 from various generally horizontal surfaces 48 (FIG. 3), the dispenser 110 is positioned, for example, but not by way of limitation, such that the upper end 132 and the resealable cover 182 from which the premoistened sheets 111 are dispensed is disposed in a superior or higher position. The dispensing opening 120 from which the dry sheets 12 are dispensed is positioned in an inferior or lower position. It will be appreciated that these positions may be reversed, with no detrimental effects to the dispenser 110 or the premoistened sheets 111 or dry sheets 12. Either of these positions permits dispensing of dry sheets 12 or premoistened sheets 111 for use, for example, as facial tissue sheets, wet wiping sheets, and so forth. However, as often occurs in a bathroom, it is desirable to have a dispenser 110 which is suitable for dispensing dry sheets 12 for use as bath or toilet tissue as well as premoistened sheets 111. The dispenser 110 easily adapts to this task, converting from a table top dispenser to a dispenser which couples to a conventional rolled product fixture for dispensing sheets for use as bath or toilet tissue.

The dispenser 110, as shown in FIG. 4, has a sling 150 which is attached to a portion of the housing 114. The sling 150 is overlapped and positioned against the housing 114 and held in place by a removable adhesive seal (as shown, for example, in FIG. 1), and so forth, when the dispenser 110 is positioned for use on a horizontal surface 48 for dispensing facial tissue, wet wiping sheets, and so forth. When the dispenser 110 is desired for use as toilet tissue, the seal is removed, and the sling 150 is expanded and ready to be positioned on a roll mount 54 of a conventional rolled product fixture 56 which traditionally holds a roll of toilet tissue.

When the housing 114 is suspended from the roll mount 54, the housing 114 is positioned diagonally with respect to the roll mount 54. The perimeter flange edges 142 of the housing 114 are positioned perpendicularly with respect to a generally vertical support surface 62 upon which the fixture 56 is mounted. In this position, the front wall 128 and the dispensing opening 120 therein from which the dry sheets 12 are dispensed is at an oblique lower or inferior position. The upper end 132 and the resealable cover 182 from which the premoistened sheets 111 are dispensed is positioned at an oblique and higher position, adjacent the roll mount 56. The sling 150 includes an opening 190 therein, to provide access to the premoistened sheets 111 when the dispenser 110 is positioned on a horizontal surface 48, and when the dispenser 110 is releasably coupled to a roll mount 56. At the junction of the upper end 132 and the back wall 130 which may be positioned at about a 90 degree angles relative to each other, a rounded upper edge 172 which is the highest structure of the housing 114 (other than the sling 150) is provided. In this position, both the upper end 132 and the back wall 130 are positioned at an oblique angle relative to the adjacent generally vertical support surface 62. At the junction of the front wall 128 and the lower end 134, which may be positioned at about a 90 degree angle relative to each other, a rounded lower edge 174 provides the lowest structure of the housing 114, when the dispenser 110 is coupled to a fixture 56. Both the front wall 122 and the lower end 134 are positioned at an oblique angle relative to the adjacent generally vertical support surface 62.

A first axis 77 is positioned through the roll mount 54, the sling 150, the upper rounded edge 172 and the lower rounded edge 174 and is postioned substantially vertically therethrough. The first axis 77 is also positioned substantially parallel to the substantially vertical support surface 62. A second axis 78 is positioned through the junctions 144, 146 (depth dimension 81) and is desirably substantially perpendicular to the first axis 77 and the substantially vertical support surface 62. The dry sheets 12 in the dispensing position on a fixture 56 are desirably positioned at an oblique angle on a third axis 79 relative generally to the vertical support surface 62, the first axis 77 and the second axis 78 as illustrated in FIG. 2. Further, the premoistened sheets 111 in the dispensing position on a fixture 56 are desirably positioned at an oblique angle on a fourth axis 192. This is unlike the dispensing position of the dry sheets 12 and premoistened sheets 111 from a horizontal surface 48, where the dry sheets 12 and the premoistened sheets 111 are dispensed at either a perpendicular angle relative to the horizontal support surface 48, or are parallel to the horizontal support surface 48 when the housing 12 is rotated as previously described herein.

The dispenser 110 and the housing 114 include width, length, and depth dimensions 70, 80, 81, respectively. These dimensions are the same as those previously described for dispenser 10 and housing 14. In addition, it will be appreciated that the dispenser 110 and the housing 114 may include any features and/or characteristics shown and/or described herein for any dispenser and housing.

It will be understood that the position of the premoistened sheets and/or the dry sheets within the housing of any embodiment of this invention may be reversed, and they need not be in a specific configuration, and may take on any suitable arrangement, including a stacked arrangement, a side-by-side arrangement, a coaxial arrangement, and so forth. Any number of configurations may be used for simultaneously dispensing dry and premoistened sheets from a single housing. All such configurations are within the scope and spirit of the present invention.

Figure 7:
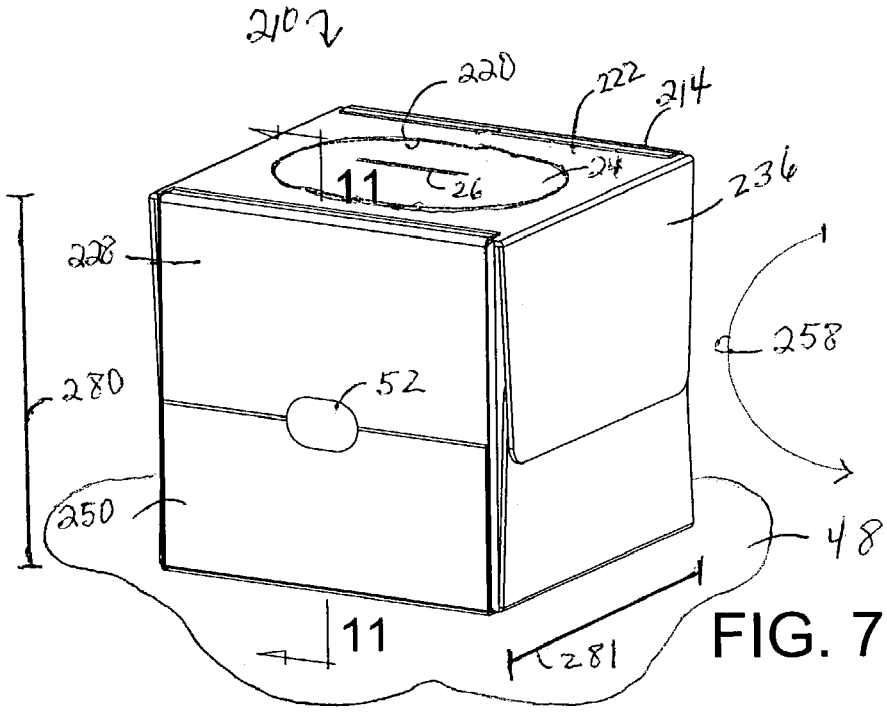
FIG. 7 is a perspective view of an yet another embodiment of the dispenser of the present invention, showing the dispenser in its dispensing position on a substantially horizontal surface for dispensing dry sheets therefrom.
Figure 8:
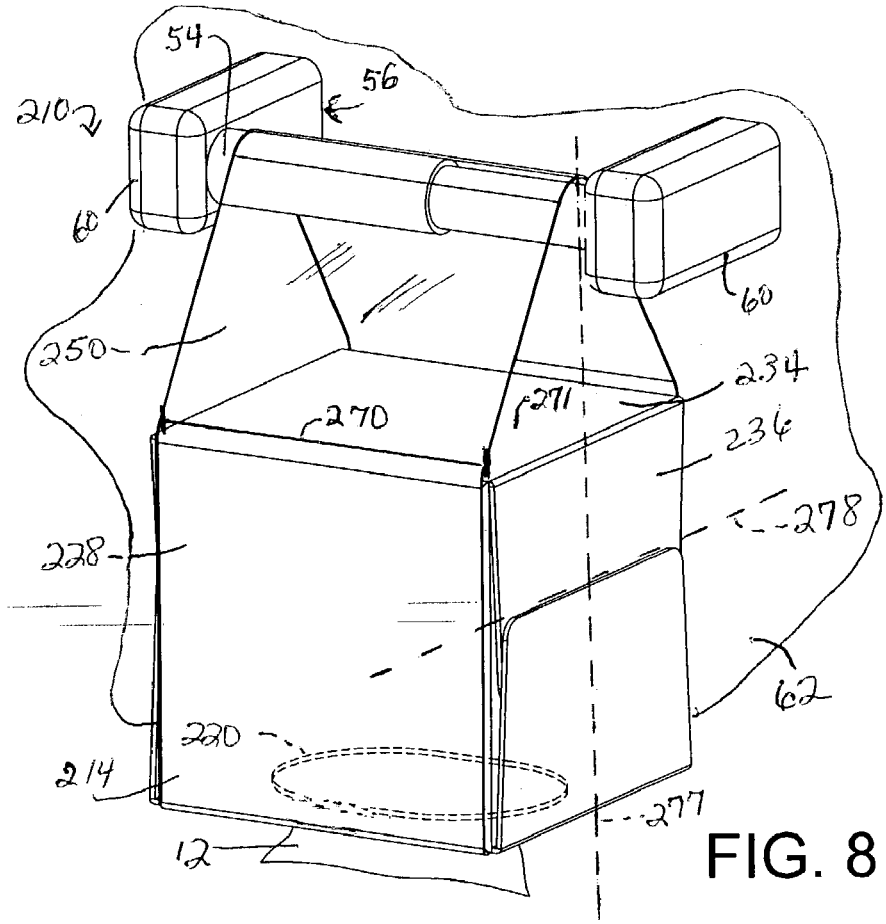
FIG. 8 is perspective view of the dispenser of FIG. 7, but showing the dispenser in its dispensing position for dispensing dry sheets when hung by its sling from a roll mount of a conventional rolled product fixture.
Figure 9:
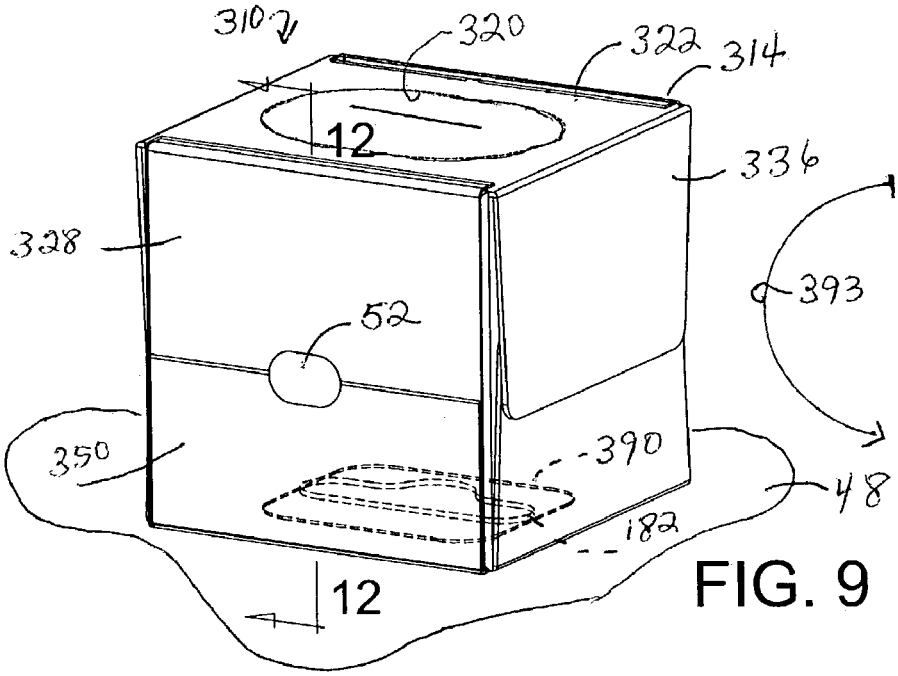
FIG. 9 is still yet another embodiment of a dispenser of the present invention, showing the dispenser in its dispensing position on a substantially horizontal surface for dispensing either dry sheets or premoistened sheets therefrom.
Figure 10:
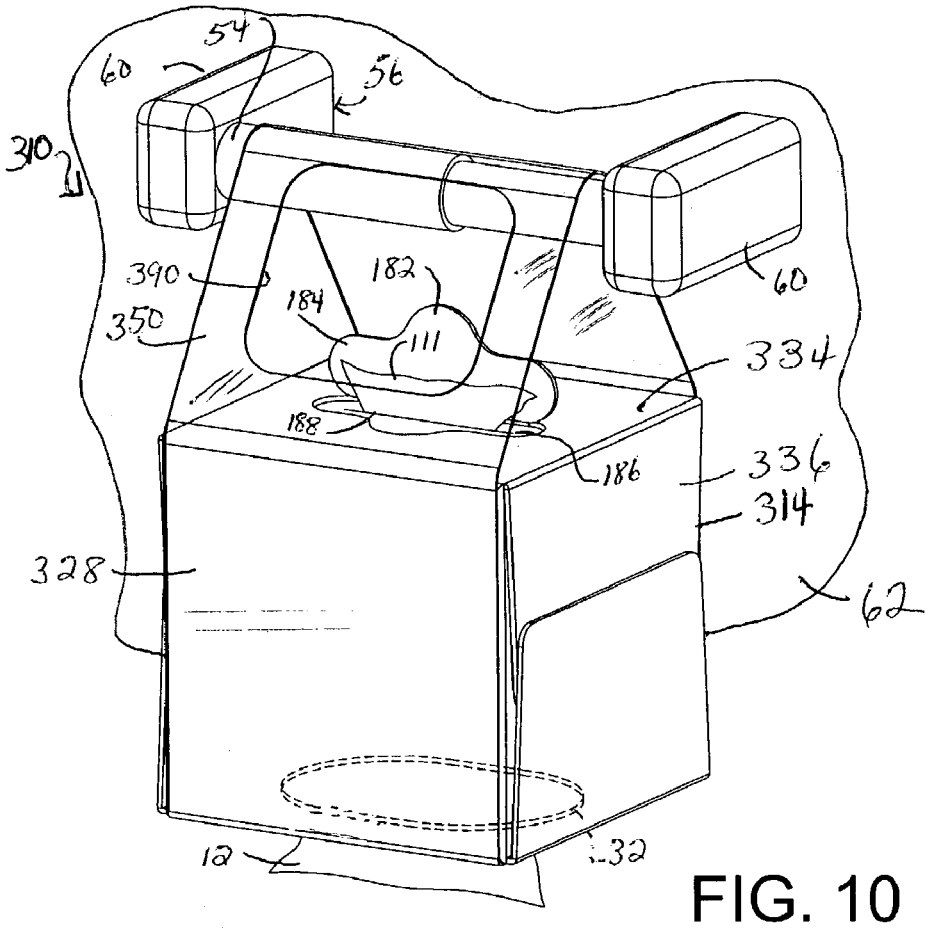
FIG. 10 is a perspective view of the dispenser of FIG. 9, but showing the dispenser in its dispensing position for dispensing dry sheets and premoistened sheets when hung by its sling from a roll mount of a conventional rolled product fixture.
Figure 11:
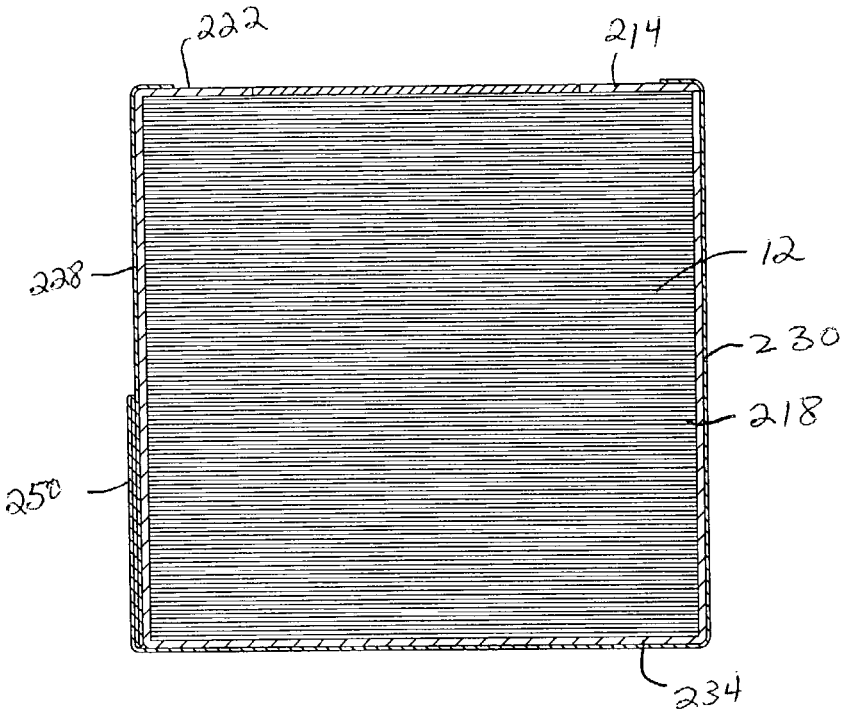
FIG. 11 is a sectional view of FIG. 7 taken along line 11—11.
Figure 12:
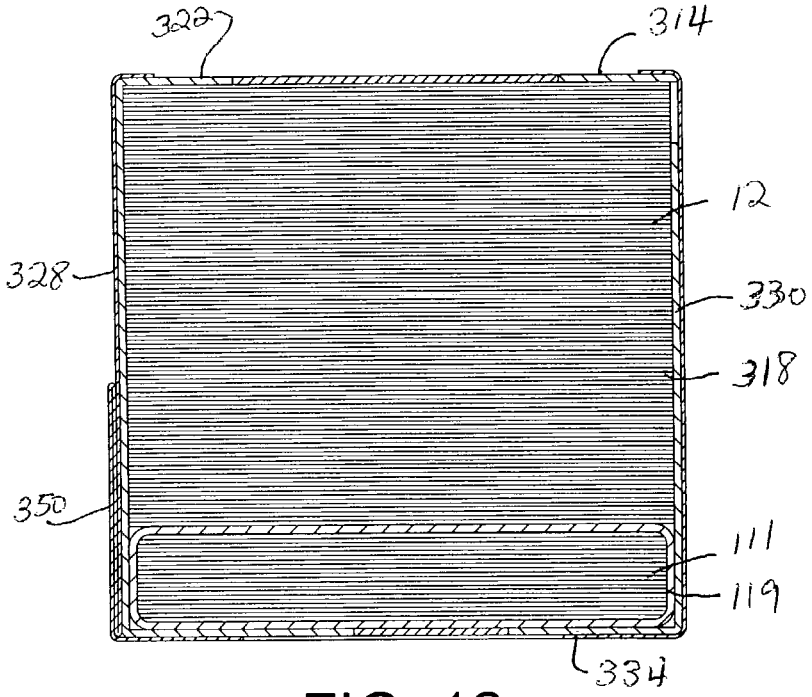
FIG. 12 is a sectional view of FIG. 9 taken along line 12—12.

The dispenser shown in FIGS. 7, 8 and 11 discloses a dispenser containing sheets. The dispenser may be used to dispense sheets from a table top for use as facial tissue sheets. The dispenser also has a sling coupled to front and back walls of the housing which permits it to be releasably coupled to a conventional rolled product fixture to provide dry sheets for bath or toilet tissue. The dispenser shown in FIGS. 9, 10 and 12 is similar to the previous dispenser, but dispenses premoistened sheets as well as dry sheets.

Turning now to FIGS. 7, 8 and 11, a dispenser 210 according to the invention is provided for desirably, but not by way of limitation, dispensing dry sheets 12. The dispenser 210 and housing 214 is similar to the dispenser 10 and housing 214 previously shown and described in detail herein.

The dispenser 210 includes a housing 214 which has a compartment 218 in which dry sheets 12 are stored and dispensed therefrom. A dispensing opening 220 is defined in the housing 214 to permit access to the compartment 218 and the dry sheets 12 therein. The dispensing opening 220 desirably is provided by way of non-limiting example in a upper end 222.

The housing 214 includes front and back walls 228, 230 and upper and lower ends 222, 234. Sidewalls 236 cooperate with the walls 228, 230 and ends 222, 234 to provide the housing 214. Desirably, but not by way of limitation, the housing 214 may be formed to generally conform to a certain amount of dry sheets 12 provided in the housing 214. In the present embodiment, the dry sheets 12 as a group have a generally polygonal shape. Similarly, by way of non-limiting example, the housing 214 has a polygonal shape as well.

The dispenser 210 is used to dispense dry sheets 12 from a generally horizontal surface 48, such as, for example, a table top, and so forth. When the dispenser 210 is positioned on such a horizontal surface 48, the structure, namely the wall or end having the dispensing opening 220 therein, such as the upper end 222, is desirably disposed in a superior or higher position, as shown in FIG. 7. It will be appreciated, however, that any position may be used to dispense dry sheets 12, such as tissue sheets used as facial tissue, and so forth, from a horizontal surface 48 such as a table top. However, as often occurs in a bathroom, it is desirable to have a dispenser 210 which is suitable for dispensing dry sheets 12 for use as bath or toilet tissue. The dispenser 210 easily adapts to this task, converting from a table top dispenser to a dispenser which couples to a conventional rolled product fixture for dispensing sheets for use as bath or toilet tissue.

As shown in FIG. 7, the dispenser 210 desirably includes a sling 250 which is attached to a portion of the housing 214, in this instance, a portion of the front wall 228 and a portion of the back wall 230. The sling 250 is overlapped and positioned against the housing front wall 228 and it is held in place by a removable adhesive seal 52 when the dispenser 210 is positioned for use on a horizontal surface 48 for dispensing dry sheets 12 as facial tissue, and so forth. This masks the sling 250 against the housing 214 and hides the purpose of the sling 250. When the dispenser 210 is desired for use as a dispenser for toilet tissue, the seal 52 is removed, and the sling 250 is extended and ready to be positioned on a roll mount 54 of a conventional rolled product fixture 56.

The dispenser 210 shown in FIG. 7 is rotated in a direction 258 and the sling 250 is positioned over a roll mount 54 which is releasably coupled to the fixture 56, as illustrated in FIG. 8. The fixture, including the side support arms 60 and the roll mount 54, have been described in detail previously herein. The roll mount 54 is positioned under the sling 250 so that the dispenser 210 may be releasably coupled to the roll mount 54 and the fixture 56. The sling 250 is coupled to the housing 214 near the junction of the lower end 234 and front wall 228 and the junction of the lower end 234 and the back wall 230. The sling 250, and any embodiment of the sling shown and/or described herein, may be heat sealed, adhesively sealed ultrasonically sealed, or formed integrally with any housing shown and/or described herein.

When the housing 214 is suspended from the roll mount 54, the housing 214 is positioned such that it is substantially parallel to the vertical support surface 62. The upper end 222 and the dispensing opening 220 therein is positioned in an inferior or lower position relative to the lower end 234 which is adjacent the sling 250, which is now positioned at a superior or higher position.

The housing 214, particularly the sling 250 and the upper portion 271 of the housing 214, has a width dimension 270, which corresponds to less than a width dimension between support arms 60 (FIG. 2). The housing 214 also has a length dimension 280 which extends from the upper end 222 to the lower end 234. The housing also has a depth dimension 281 which extends from the front wall 228 to the back wall 230.

A first axis 277 may be positioned through the roll mount 54, the sling 250, the stack of dry sheets 12 therein to the dispensing opening 220 and is substantially vertical in position. A second axis 278 may be positioned through the front wall 228 and the back wall 230 and be positioned substantially parallel to the sheets contained therein. The second axis 278 may be perpendicular to the first axis 277 and/or to the vertical support surface 62. The housing 214 when coupled to a fixture 56 is substantially parallel to the vertical support surface 62.

The housing 214 may desirably be non-refillable, and when the dry sheets 12 are removed, the dispenser 10 is disposed of. However, the housing may be refillable. It refillable, the housing 214 will open along the junction of the edges (not shown). At least a portion of the edges may be connected by hinges, such as living hinges, fasteners, latches, and so forth, to permit access and closure to the compartment.

If the dispenser 210 permits refilling, a plurality of dry sheets 12 are disposed in the compartment 218 of the housing 214. In this instance, the dry sheets 12 may be provided in a cartridge of sheets (not shown). Such a cartridge is formed about at least a portion of the dry sheets to couple a plurality of dry sheets together. The cartridge may be a band, or may provide a housing (not shown). In this situation, an opening is provided in at least one surface of the cartridge which desirably aligns with a dispensing opening in the housing, to permit dispensing of the sheets therefrom. In addition, it will be appreciated that the dispenser 210 and the housing 214 may include any features and/or characteristics shown and/or described herein for any dispenser and housing.

In another embodiment of the invention, as illustrated in FIGS. 9, 10 and 12, the dispenser 310 and housing 314 are very similar to the dispenser 210 and the housing 214 shown in FIGS. 7, 8, and 11, and previously described in detail herein. The dispenser 310, however, is adapted to provide premoistened sheets 111 as well as dry sheets 12 from a single housing 314. The compartment 318 contains a plurality of dry sheets 12. The compartment 318 also includes a container 119 of premoistened sheets 111 as well. The container 119 of premoistened sheets 111, as illustrated in FIG. 12, may be provided as a separate container 119. Alternatively, however, the container 119 of premoistened sheets 111 may be provided as a portion of a cartridge which includes dry sheets 12 (not shown).

The housing 314, similar to the housing 214, includes front and back walls 328, 330 and upper and lower ends 322, 334. Sidewalls 336 cooperate with the walls 328, 330 and ends 322, 334 to provide closure and a compartment 318 in the housing 314. Desirably, but not by way of limitation, the housing 314 may be formed to generally conform to a certain amount of dry sheets 12 and premoistened sheets 111. In the present embodiment, the dry sheets 12 and the container 119 of premoistened sheets 111 may together have a generally polygonal shape.

The premoistened sheets 111 are dispensed from the container 119 from an opening (not shown) in the container 119 and through a dispensing opening (not shown) in the housing 114. The dry sheets 12 are dispensed from the dispensing opening 320 in the upper end 322 of the housing 314, as illustrated in FIG. 9.

As shown in FIGS. 9 and 10, a resealable cover 182 may be positioned on the lower end 334 over the dispensing opening (not shown) in the housing 314 which is aligned with the opening (not shown) in the container 119 of premoistened sheets 111. The premoistened sheets 111 are then accessed through the resealable cover 182 to permit dispensing of the premoistened sheets 111 from the dispenser 310. Alternatively, or, in addition thereto, the container 119 may also include a resealable cover 182 which is aligned with the dispensing opening of the housing 314 to permit access to the premoistened sheets 119 as well (not shown).

The resealable cover 182 is used to maintain the moisture conditions within the container 119 and to prevent undesired drying out of the premoistened sheets 111. In a non-limiting example of one possible resealable cover 182, FIG. 10 discloses a resealabe cover 182 which includes an upper flap 184 which is coupled to a portion of a lower flap 186, which has an opening or slit 188 opening therein, through which the premoistened sheets 111 are withdrawn. The upper flap 184 releasably engages the lower flap 186 to provide a releasable closure to the housing 314 and the container 119. Such releasable and resealable features between the upper and lower flaps 184, 186 is provided, by way of non-limiting example, an adhesive, such as a pressure sensitive adhesive, a cohesive adhesive, such as a latex or other natural rubber material, and so forth. Other resealable mechanisms, such as, by way of non-limiting example, snap-fit, hinged cover and lid, and so forth are known and may be used; any resealable mechanism known in the art may be used with any dispensing opening in the housing and/or any opening in the container.

As illustrated in FIG. 12, the housing 314 desirably is an integral unit such that one compartment contains the dry sheets 12 and the container 119 of premoistened sheets 111. However, alternatively, the housing 314 may include first and second compartments formed separately such that one compartment holds dry sheets and another compartment holds the container of premoistened sheets (not shown). Such compartments may be delineated by separate cartridges or containers, or, by way of non-limiting example, the housing may have at least a portion of an inner wall (not shown) in which to provide first and second compartments (not shown).

The premoistened sheets 111 may be encased in a liquid impermeable film, and this film may provide a portion, or all, of the container 119 as shown in FIG. 12. In a further example, the container 119 may be formed from at least one other material, and the container 119 may be lined with the film (not shown).

When the dispenser 310 is used to dispense dry sheets 12 and premoistened sheets 111 from various generally horizontal surfaces 48, the dispenser 310 may be positioned in various positions to permit access to premoistened sheets 111 or dry sheets 12. For example, as shown in FIG. 9, the dispenser is positioned such that the upper end 322 having the dispensing opening 320 therein is positioned in a superior or higher position relative to the premoistened sheets 111. Alternatively, the housing may be turned a direction 393 about 180 degrees such that the lower end 334 and the resealable cover 182 from which the premoistened sheets 111 are dispensed is now disposed in a superior or higher position relative to the dry sheets 12 (not shown). It will be appreciated that these positions create no detrimental effects to the dispenser 310 or the premoistened sheets 111 or dry sheets 12. Either of these positions permits dispensing of dry sheets 12 or premoistened sheets 111 for use, for example, as facial tissue sheets, wet wiping sheets, and so forth. However, as often occurs in a bathroom, it is desirable to have a dispenser 310 which is suitable for dispensing dry sheets 12 for use as bath or toilet tissue as well as premoistened sheets 111. The dispenser 310 easily adapts to this task, converting from a table top dispenser to a dispenser which couples to a conventional rolled product fixture for dispensing sheets for use as bath or toilet tissue.

The dispenser 310, as shown in FIG. 9, has a sling 350 which is attached to a portion of the housing 314. The sling 350 is overlapped and positioned against the housing 114 and held adhesively in place and/or is held in place by a removable adhesive seal 52, and so forth, when the dispenser 310 is positioned for use on a horizontal surface 48 for dispensing facial tissue, wet wiping sheets, and so forth. The sling 350 includes an opening 390 therein, which permits access to the resealable cover 182 and the premoistened sheets dispensed therethrough. When the dispenser 310 is desired for use as toilet tissue, the seal 52 is removed, and the sling 350 is expanded and ready to be positioned on a roll mount 54 of a conventional bath tissue fixture 56 which traditionally holds a roll or toilet tissue.

When the housing 314 is suspended from the roll mount 54, the housing 314 desirably is positioned substantially parallel with respect to adjacent vertical support surface 62. It will be appreciated that the housing 314 is positioned the same as the housing 214 along axis 277 and axis 278. In this position, the lower end 334 having the premoistened sheets 111 dispensed through the resealable cover 182 are positioned in a superior or higher position adjacent the sling 350 and the roll mount 54, and the upper end 322 having the dispensing opening 320 through which dry sheets 12 are dispensed is positioned in an inferior or lower position.

The dispenser 310 and the housing 314 include width, length, and depth dimensions. These dimensions are the same as those previously shown and/or described for dispenser 210 and housing 214. In addition, it will be appreciated that the dispenser 310 and the housing 314 may include any features and/or characteristics shown and/or described herein for any dispenser and housing.

Figure 13:
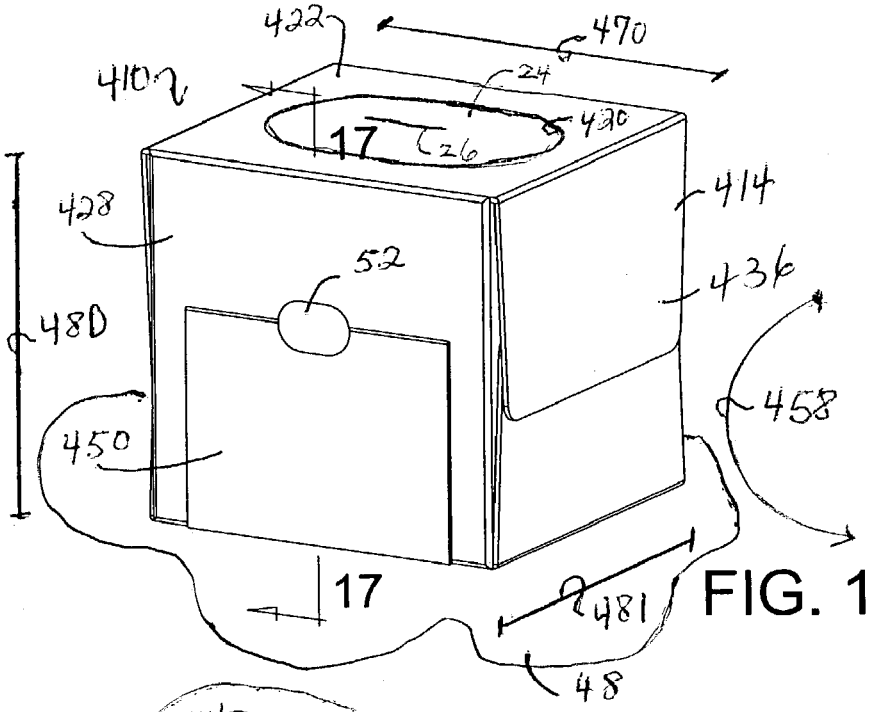
FIG. 13 is a perspective view of a further embodiment of the dispenser of the present invention, showing the dispenser in its dispensing position on a substantially horizontal surface for dispensing dry sheets therefrom.
Figure 14:
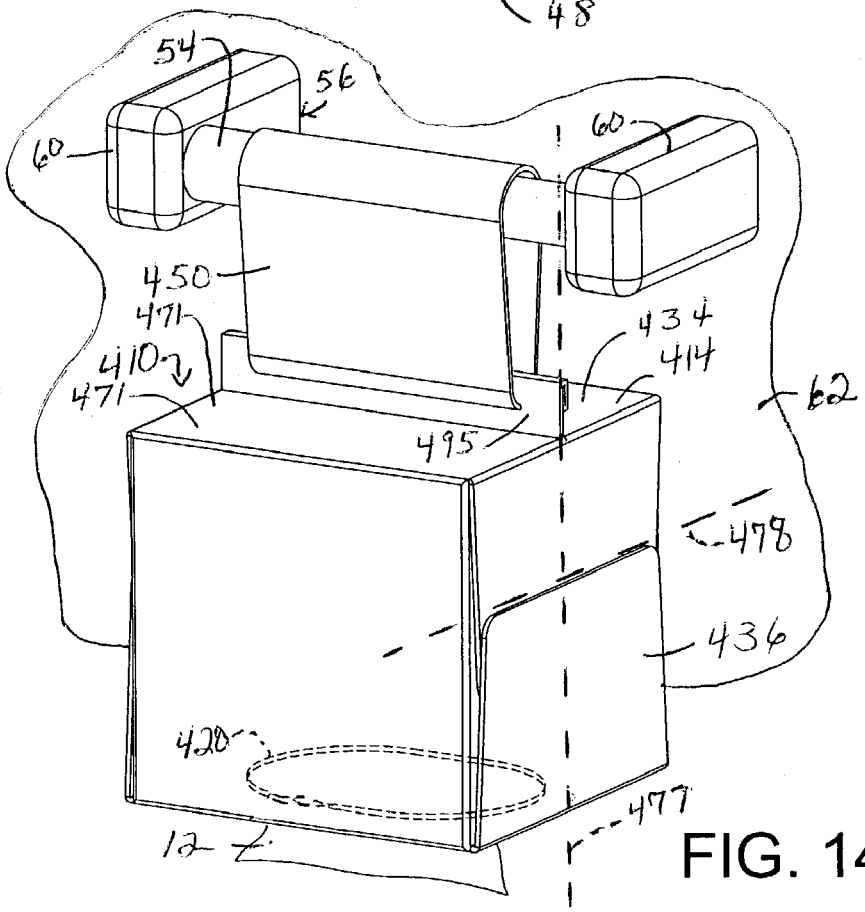
FIG. 14 is perspective view of the dispenser of FIG. 13, but showing the dispenser in its dispensing position for dispensing dry sheets when hung by its sling from a roll mount of a conventional rolled product fixture.
Figure 15:
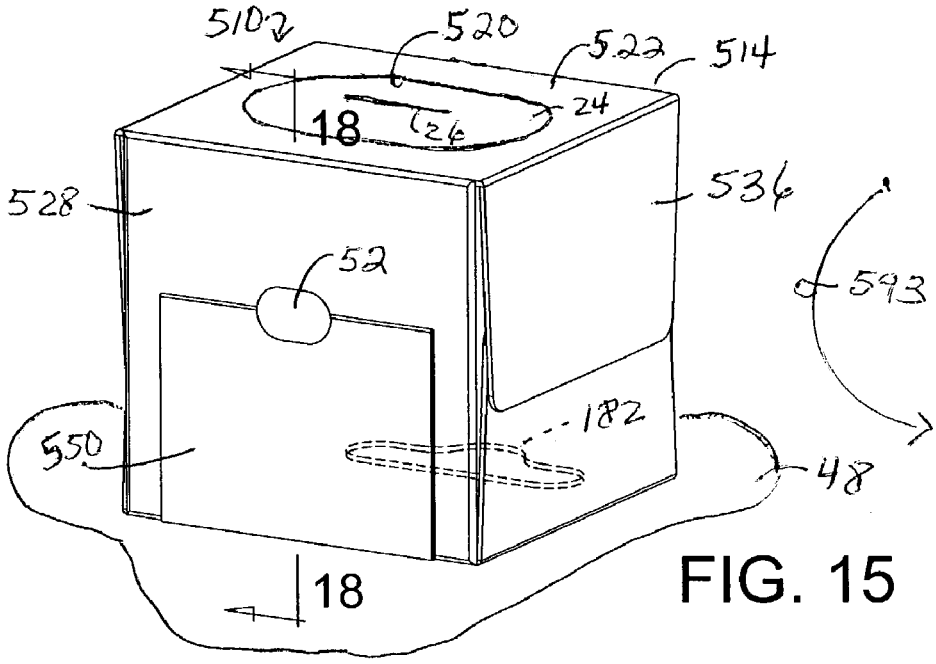
FIG. 15 is yet a further embodiment of a dispenser of the present invention, showing the dispenser in its dispensing position on a substantially horizontal surface for dispensing either dry sheets or premoistened sheets therefrom.
Figure 16:
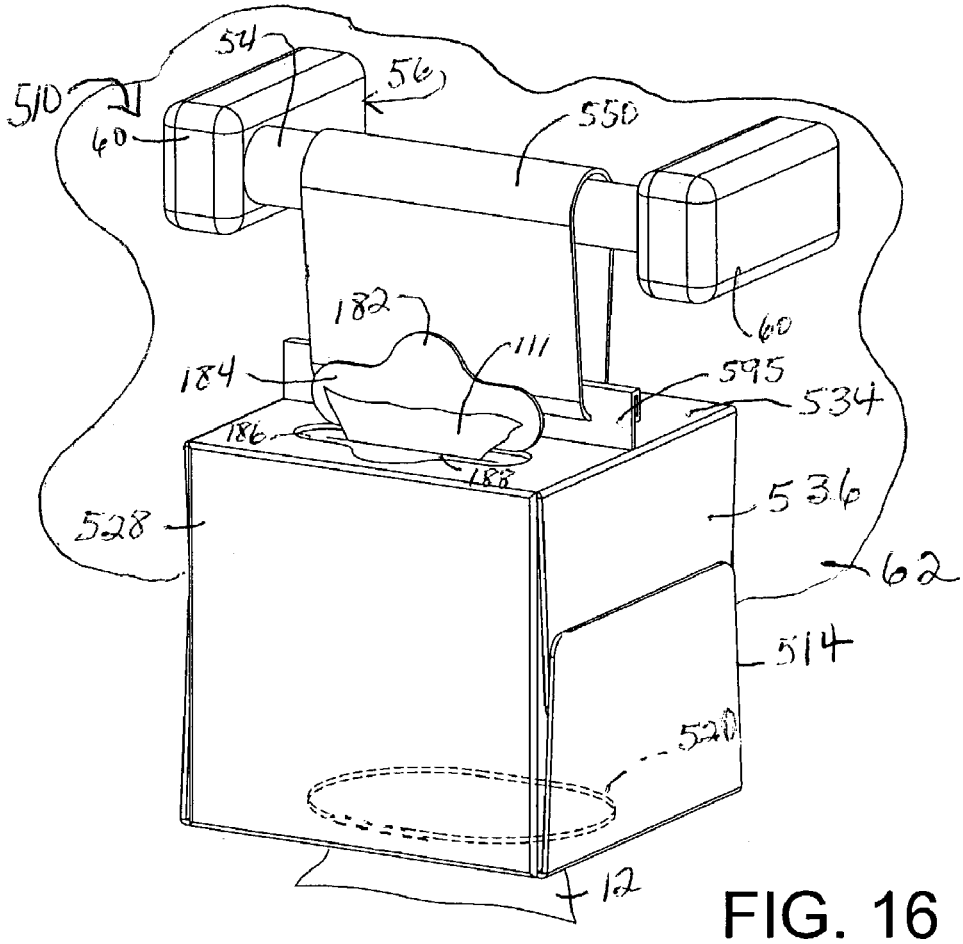
FIG. 16 is a perspective view of the dispenser of FIG. 15, but showing the dispenser in its dispensing position for dispensing dry sheets and premoistened sheets when hung by its sling from a roll mount of a conventional rolled product fixture.
Figure 17:
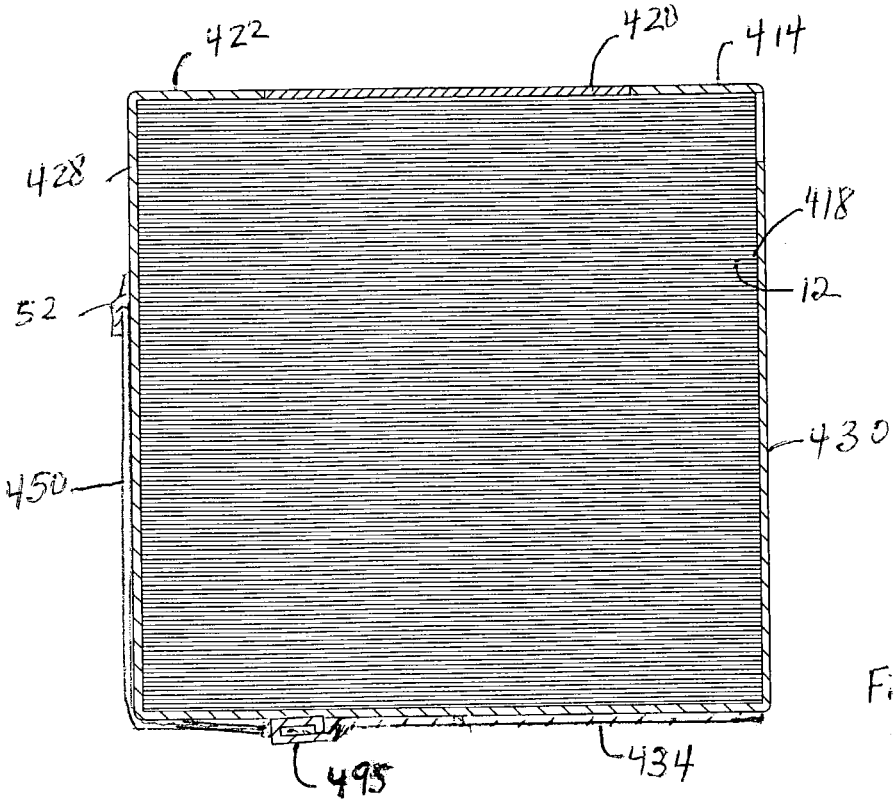
FIG. 17 is a sectional view of FIG. 13 taken along line 17—17.
Figure 18:
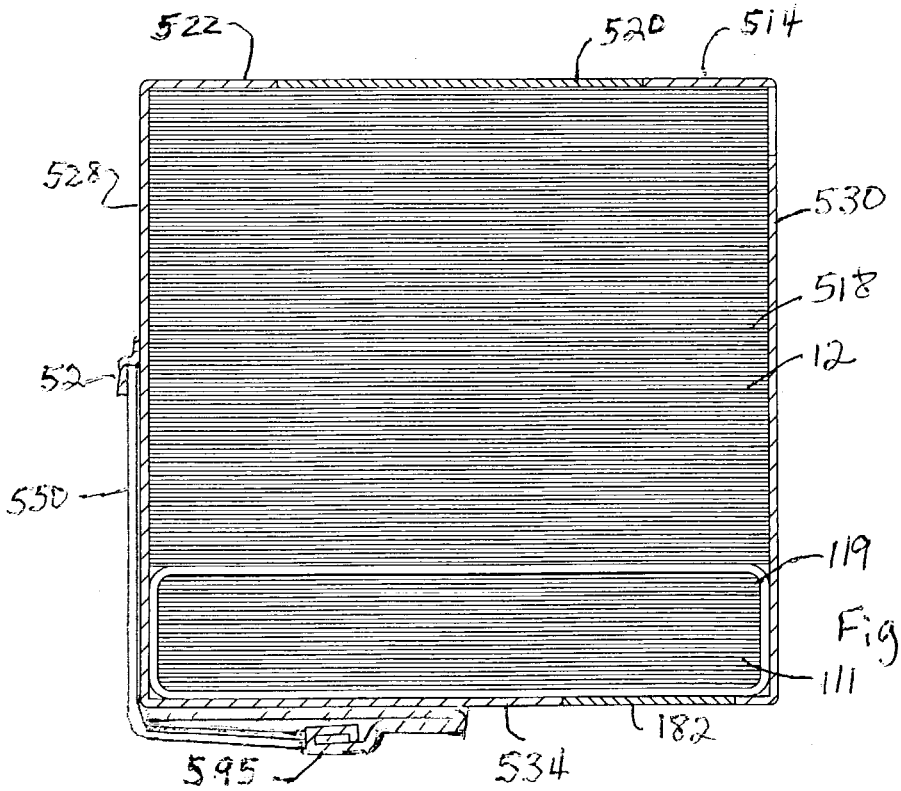
FIG. 18 is a sectional view of FIG. 15 taken along line 18—18.

The dispenser shown in FIGS. 13, 14 and 17 discloses a dispenser containing sheets. The dispenser may be used to dispense sheets from a table top for use as facial tissue sheets. The dispenser also has a sling which extends from a mid-section of the upper end which permits it to be releasably coupled to a conventional rolled product fixture to provide dry sheets for bath or toilet tissue. The dispenser shown in FIGS. 15, 16 and 18 is similar to the previous dispenser, but dispenses premoistened sheets as well as dry sheets.

Turning now to FIGS. 13, 14 and 17, a dispenser 410 according to the invention is provided for desirably, but not by way of limitation, dispensing dry sheets 12. The dispenser 410 and housing 414 are similar to the dispenser 210 and housing 214 previously shown and described in detail herein.

The dispenser 410 includes a housing 414 which has a compartment 418 in which dry sheets 12 are stored and dispensed therefrom. A dispensing opening 420 is defined in the housing 414 to permit access to the compartment 418 and the dry sheets 12 therein. The dispensing opening 420 desirably is provided by way of non-limiting example in an upper end 422.

The housing 414 includes front and back walls 428, 430 and upper and lower ends 422, 434. Sidewalls 436 cooperate with the walls 428, 430 and ends 422, 434 to provide compartment 418 and closure to the housing 414. Desirably, but not by way of limitation, the housing 414 may be formed to generally conform to a certain amount of dry sheets 12 provided in the housing 414. In the present embodiment, the dry sheets 12 as a group have a generally polygonal shape. Similarly, by way of non-limiting example, the housing 414 may have a polygonal shape as well.

The dispenser 410 is used to dispense dry sheets 12 from a generally horizontal surface 48, such as, for example, a table top, and so forth. When the dispenser 410 is positioned on such a horizontal surface 48, the structure, namely the wall or end having the dispensing opening 420 therein, such as the upper end 422, is desirably disposed in a superior or higher position, as shown in FIG. 7. It will be appreciated, however, that any position may be used to dispense dry sheets 12, such as tissue sheets used as facial tissue, and so forth, from a horizontal surface 48 such as a table top. However, as often occurs in a bathroom, it is desirable to have a dispenser 410 which is suitable for dispensing dry sheets 12 for use as bath or toilet tissue. The dispenser 410 easily adapts to this task, converting from a table top dispenser to a dispenser which couples to a conventional rolled product fixture for dispensing sheets for use as bath or toilet tissue.

As shown in FIG. 13, the dispenser 410 desirably includes a sling 450 which is attached to a portion 495 having an opening (not shown) therein through which the sling 450 is attached. The portion 495 desirably is coupled to or integrally formed with the lower end 434 of the housing 414. The sling 450 is overlapped and positioned against a portion of the lower end 434 and the front wall 428 of the housing 414 and held in place by a removable adhesive seal 52 when the dispenser 410 is positioned for use on a horizontal surface 48 for dispensing dry sheets 12 as facial tissue, and so forth. This position masks the sling 450 against the housing 414 and hides the purpose of the sling 450. When the dispenser 410 is desired for use as a dispenser for toilet tissue, the seal 52 is removed, and the sling 450 is extended and ready to be positioned on a roll mount 54 of a conventional rolled product fixture 56.

The dispenser 410 shown in FIG. 13 is rotated in a direction 458 and the sling 450 is positioned over a roll mount 54 which is releasably coupled to the fixture 56, as illustrated in FIG. 14. The fixture 56, including the side support arms 60 and the roll mount 54, have been described in detail previously herein. The roll mount 54 is positioned through the sling 450 so that the dispenser 410 may be releasably coupled to the roll mount 54 and the fixture 56. The sling 450, and any embodiment of the sling shown and/or described herein, may be heat sealed, adhesively sealed ultrasonically sealed, or formed integrally with itself in a loop.

When the housing 414 is suspended from the roll mount 54, the housing 414 is positioned such that it is substantially parallel to the vertical support surface 62. The upper end 422 and the dispensing opening 420 therein is positioned in an inferior or lower position relative to the lower end 434 and the portion 495 which is coupled to the sling 450, which is now positioned at a superior or higher position.

The housing 414, particularly the sling 450 and the upper portion 471 of the housing 414, has a width dimension 470 which corresponds to less than the width dimension 68 between support arms 60 (FIG. 2). The housing 414 also has a length dimension 480 which extends from the upper end 422 to the lower end 434. The housing also has a depth dimension 481 which extends from the front wall 428 to the back wall 430.

A first axis 477 may be positioned through the roll mount 54, the sling 450, the stack of dry sheets 12 therein to the dispensing opening 420 and is substantially vertical in position. A second axis 478 may be positioned through the front wall 428 and the back wall 430 and be positioned substantially parallel to the dry sheets 12 contained therein. The second axis 478 may be perpendicular to the first axis 477 and/or the vertical support surface 62.

The housing 414 may desirably be non-refillable, and when the dry sheets 12 are removed, the dispenser 410 is disposed of. However, the housing 414 may be refillable. It refillable, the housing 414 will open along the junction of the edges (not shown). At least a portion of the edges may be connected by hinges, such as living hinges, fasteners, latches, and so forth, to permit access and closure to the compartment.

If the dispenser 410 permits refilling, a plurality of dry sheets 12 are disposed in the compartment 418 of the housing 414. In this instance, the dry sheets 12 may be provided in a cartridge of sheets (not shown). Such a cartridge is formed about at least a portion of the dry sheets to couple a plurality of dry sheets 12 together. The cartridge may be a band, or may provide a housing (not shown). In this situation, an opening is provided in at least one surface of the cartridge which desirably aligns with a dispensing opening in the housing, to permit dispensing of the sheets therefrom (not shown). In addition, it will be appreciated that the dispenser 410 and the housing 414 may include any features and/or characteristics shown and/or described herein for any dispenser and housing.

In another embodiment of the invention, as illustrated in FIGS. 15, 16 and 18, the dispenser 510 and housing 514 are very similar to the dispenser 410 and the housing 414 shown in FIGS. 13, 14 and 17, and previously described in detail herein. The dispenser 510, however, is adapted to provide premoistened sheets 111 as well as dry sheets 12 from a single housing 514. The compartment 518 contains a plurality of dry sheets 12. The compartment 518 also includes a container 119 of premoistened sheets 111 as well. The container 119 of premoistened sheets 111, as illustrated in FIG. 18, may be provided as a separate container 119. Alternatively, however, the container 119 of premoistened sheets 111 may be provided as a portion of a cartridge which includes dry sheets 12 (not shown).

The housing 510, similar to the housing 410, includes front and back walls 528, 530 and upper and lower ends 522, 534. Sidewalls 536 cooperate with the walls 528, 530 and ends 522, 534 to provide closure and a compartment 518 in the housing 514. Desirably, but not by way of limitation, the housing 514 may be formed to generally conform to a certain amount of dry sheets 12 and premoistened sheets 111. In the present embodiment, the dry sheets 12 and the container 119 of premoistened sheets 111 may together have a generally polygonal shape.

The premoistened sheets 111 are dispensed from the container 119 from an opening (not shown) in the container 119 and through a dispensing opening (not shown) in the housing 514. The dry sheets 12 are dispensed from the dispensing opening 520 in the upper end 522 of the housing 514, as illustrated in FIG. 15.

As shown in FIGS. 15 and 16, a resealable cover 182 may be positioned on the lower end 534 over the dispensing opening (not shown) in the housing 514 which is aligned with the opening (not shown) in the container 119 of premoistened sheets 111. The premoistened sheets 111 are then accessed through the resealable cover 182 to permit dispensing of the premoistened sheets 111 from the dispenser 510. Alternatively, or, in addition thereto, the container 119 may also include a resealable cover 182 which is aligned with the dispensing opening of the housing 514 to permit access to the premoistened sheets 119 as well (not shown).

The resealable cover 182 is used to maintain the moisture conditions within the container 119 and to prevent undesired drying out of the premoistened sheets 111. In a non-limiting example of one possible resealable cover 182, FIGS. 15 and 16 disclose a resealabe cover 182 which includes an upper flap 184 which is coupled to a portion of a lower flap 186, which has an opening or slit 188 opening therein, through which the premoistened sheets 111 are withdrawn. The upper flap 184 releasably engages the lower flap 186 to provide a releasable closure to the housing 514 and the container 119. Such releasable and resealable features between the upper and lower flaps 184, 186 is provided, by way of non-limiting example, an adhesive, such as a pressure sensitive adhesive, a cohesive adhesive, such as a latex or other natural rubber material, and so forth. Other resealable mechanisms, such as, by way of non-limiting example, snap-fit, hinged cover and lid, and so forth are known and may be used; any resealable mechanism known in the art may be used with any dispensing opening in the housing and/or any opening in the container.

As illustrated in FIG. 18, the housing 514 desirably is an integral unit such that one compartment contains the dry sheets 12 and the container 119 of premoistened sheets 111. However, alternatively, the housing 514 may include first and second compartments formed separately such that one compartment holds dry sheets and another compartment holds the container of premoistened sheets (not shown). Such compartments may be delineated by separate cartridges or containers, or, by way of non-limiting example, the housing may have at least a portion of an inner wall (not shown) in which to provide first and second compartments (not shown).

The premoistened sheets 111 may be encased in a liquid impermeable film, and this film may provide a portion, or all, of the container 119 as shown in FIG. 18. In a further example, the container 119 may be formed from at least one other material, and the container 119 may be lined with the film (not shown).

When the dispenser 510 is used to dispense dry sheets 12 and premoistened sheets 111 from various generally horizontal surfaces 48, the dispenser 510 may be positioned in various positions to permit access to premoistened sheets 111 or dry sheets 12. For example, as shown in FIG. 15, the dispenser is positioned such that the upper end 522 having the dispensing opening 520 therein is positioned in a superior or higher position relative to the premoistened sheets 111 dispensed from the lower end 524. Alternatively, the housing may be turned a direction 593 about 180 degrees such that the lower end 534 and the resealable cover 182 from which the premoistened sheets 111 are dispensed is now disposed in a superior or higher position relative to the dry sheets 12 (not shown). It will be appreciated that these positions create no detrimental effects to the dispenser 510 or the premoistened sheets 111 or dry sheets 12. Either of these positions permits dispensing of dry sheets 12 or premoistened sheets 111 for use, for example, as facial tissue sheets, wet wiping sheets, and so forth. However, as often occurs in a bathroom, it is desirable to have a dispenser 510 which is suitable for dispensing dry sheets 12 for use as bath or toilet tissue as well as premoistened sheets 111. The dispenser 510 easily adapts to this task, converting from a table top dispenser to a dispenser which couples to a conventional rolled product fixture for dispensing sheets for use as bath or toilet tissue.

The dispenser 510, as shown in FIG. 15, has a sling 550 which is attached to a portion 595 of the housing 514, as previously described herein for sling 450 and portion 495. The sling 550 is overlapped and positioned against the housing 514 and held adhesively in place and/or is held in place by a removable adhesive seal 52, and so forth, when the dispenser 510 is positioned for use on a horizontal surface 48 for dispensing facial tissue, wet sheets, and so forth. When the dispenser 510 is desired for use as bath tissue, the seal 52 is removed, and the sling 550 is expanded and ready to be positioned on a roll mount 54 of a conventional bath tissue fixture 56 which traditionally holds a roll or toilet tissue.

When the housing 514 is suspended from the roll mount 54, the housing 514 desirably is positioned substantially parallel with respect to adjacent vertical support surface 62. It will be appreciated that the housing 514 is positioned the same as the housing 414 along axis 477 and 478. In this position, the lower end 534 having the premoistened sheets 111 dispensed through the resealable cover 182 are positioned in a superior or higher position adjacent the sling 550 and the roll mount 54, and the upper end 522 having the dispensing opening 520 through which dry sheets 12 are dispensed is positioned in an inferior or lower position.

The dispenser 510 and the housing 514 include width, length, and depth dimensions. These dimensions are the same as those previously shown and/or described for dispenser 410 and housing 414. In addition, it will be appreciated that the dispenser 510 and the housing 514 may include any features and/or characteristics shown and/or described herein for any dispenser and housing.

Figure 19:
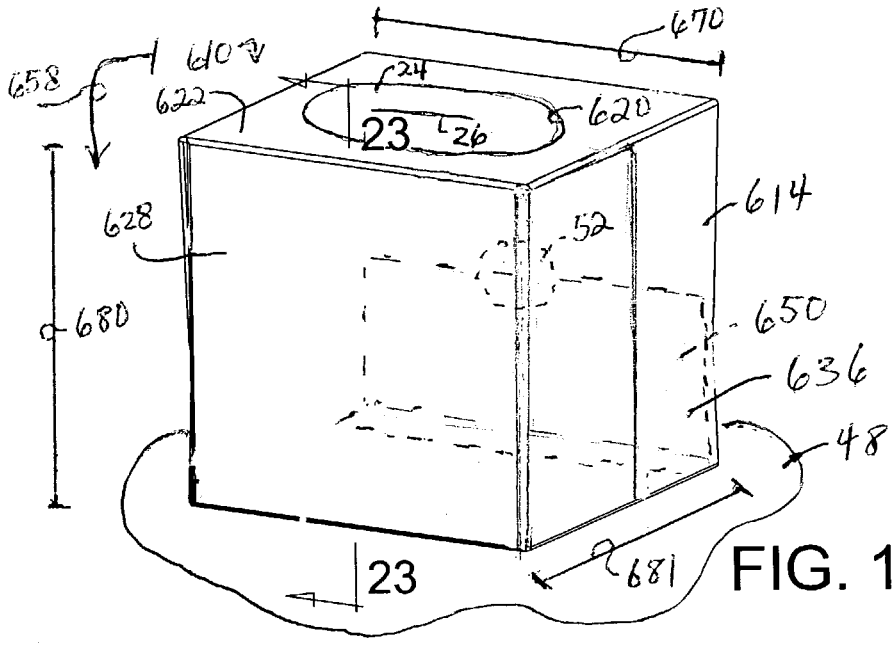
FIG. 19 is a perspective view of yet another embodiment of the dispenser of the present invention, showing the dispenser in its dispensing position on a substantially horizontal surface for dispensing dry sheets therefrom.
Figure 20:
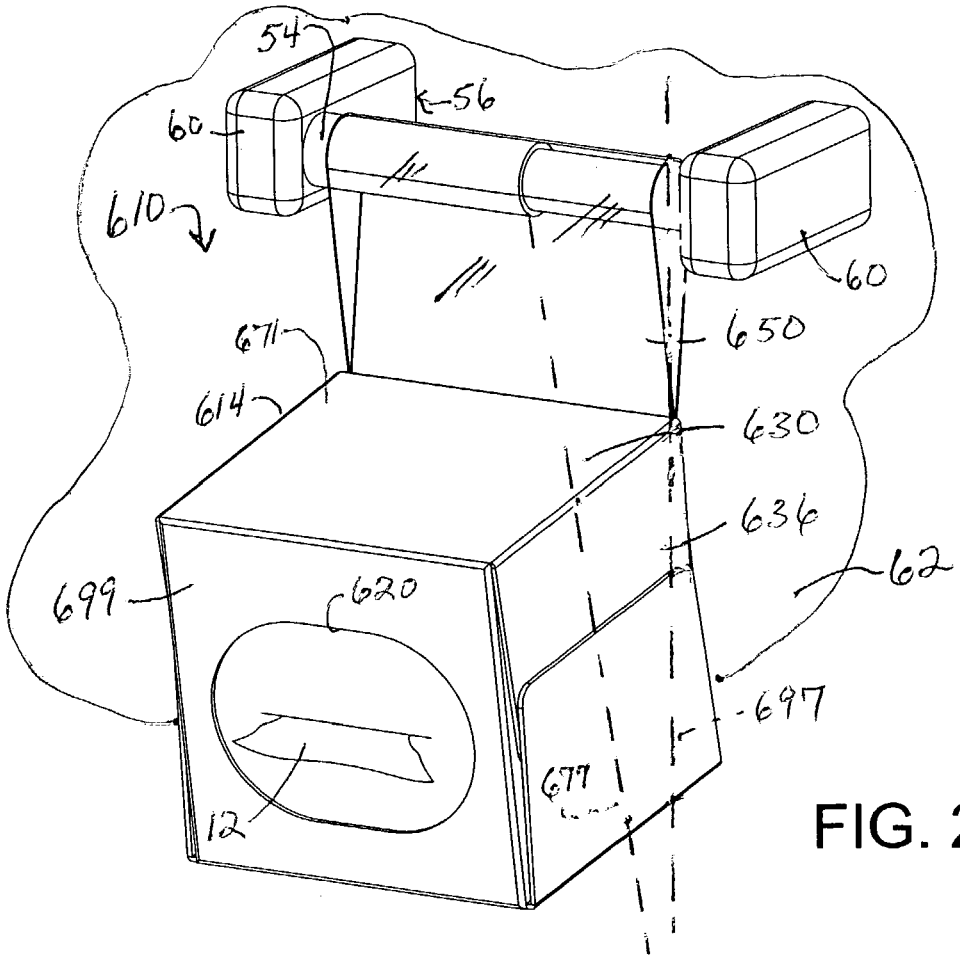
FIG. 20 is perspective view of the dispenser of FIG. 19, but showing the dispenser in its dispensing position for dispensing dry sheets when hung by its sling from a roll mount of a conventional rolled product fixture.
Figure 21:
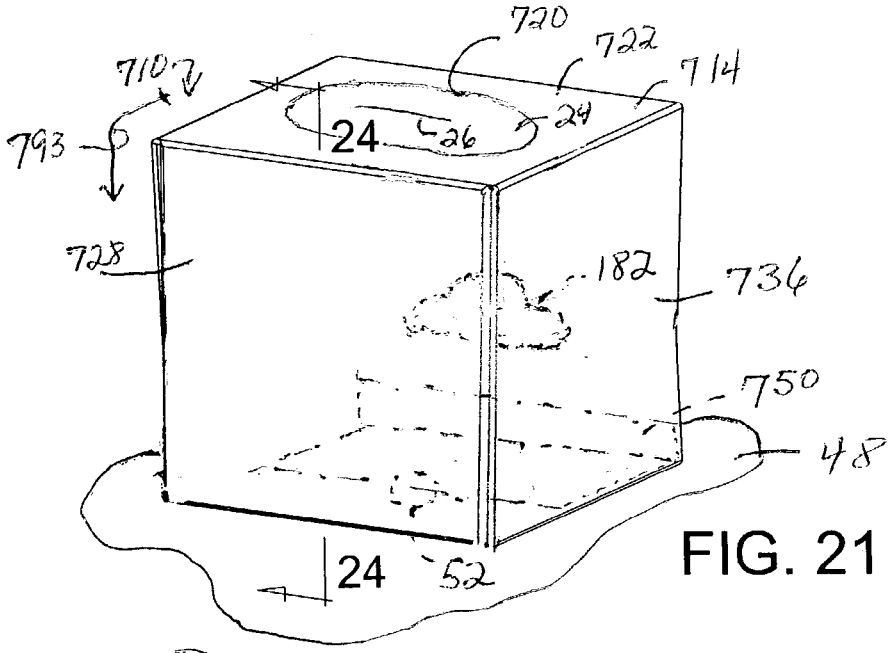
FIG. 21 is still yet another embodiment of a dispenser of the present invention, showing the dispenser in its dispensing position on a substantially horizontal surface for dispensing either dry sheets or premoistened sheets therefrom.
Figure 22:
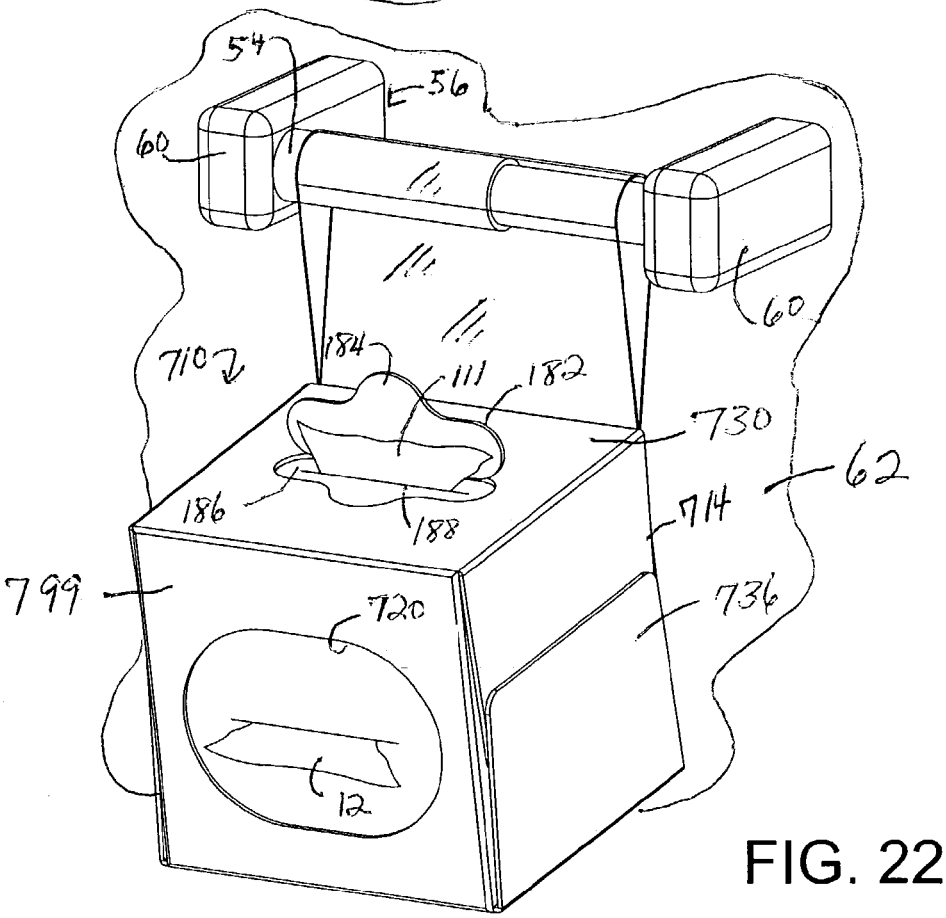
FIG. 22 is a perspective view of the dispenser of FIG. 21, but showing the dispenser in its dispensing position for dispensing dry sheets and premoistened sheets when hung by its sling from a roll mount of a conventional rolled product fixture.
Figure 24:
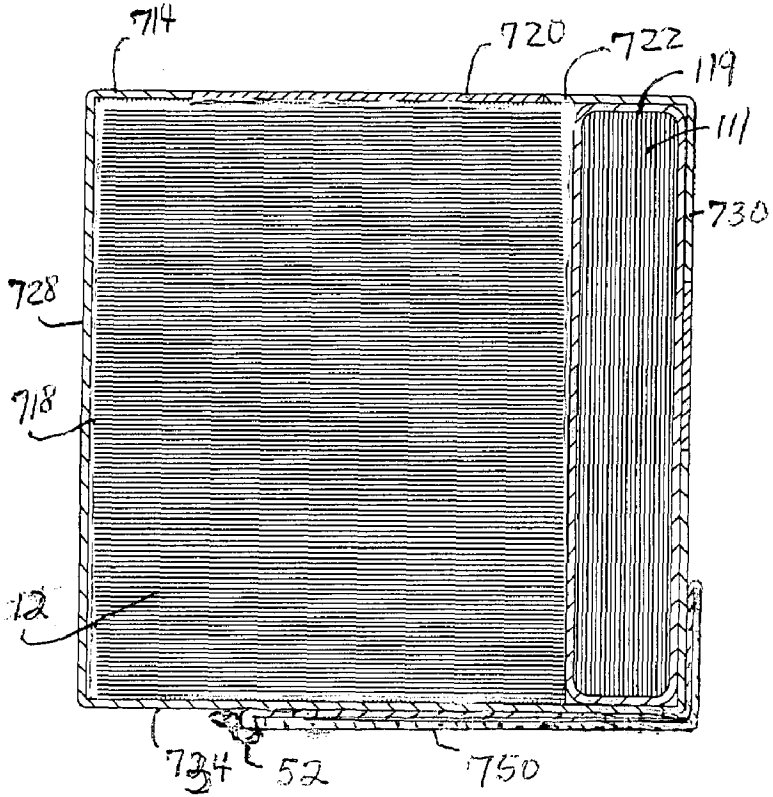
FIG. 24 is a sectional view of FIG. 21 taken along line 24—24.
Figure 23:
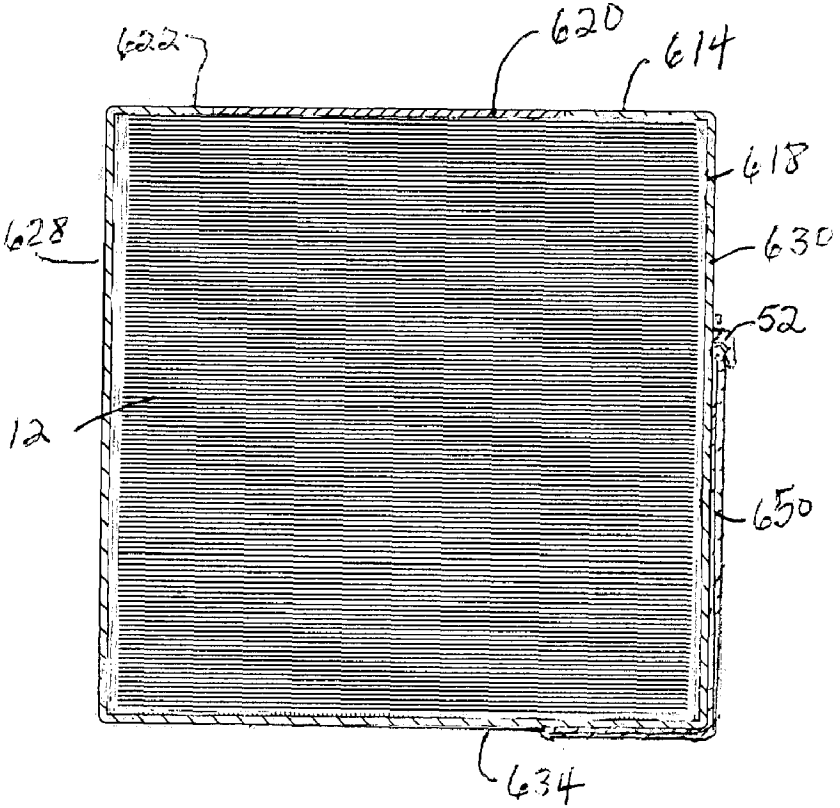
FIG. 23 is a sectional view of FIG. 19 taken along line 23—23.

The dispenser shown in FIGS. 19, 20 and 23 discloses a dispenser containing sheets. The dispenser may be used to dispense sheets from a table top for use as facial tissue sheets. The dispenser also has a sling which extends from one wall or end+ which permits it to be releasably coupled to a conventional rolled product fixture to provide dry sheets for bath or toilet tissue. The dispenser shown in FIGS. 21, 22 and 24 is similar to the previous dispenser, but dispenses premoistened sheets as well as dry sheets.

Turning now to FIGS. 19, 20 and 23, a dispenser 610 according to the invention is provided for desirably, but not by way of limitation, dispensing dry sheets 12. The dispenser 610 and housing 614 is similar to the dispenser 410 and housing 414 previously shown and described in detail herein.

The dispenser 610 includes a housing 614 which has a compartment 618 in which dry sheets 12 are stored and dispensed therefrom. A dispensing opening 620 is defined in the housing 614 to permit access to the compartment 618 and the dry sheets 12 therein. The dispensing opening 620 desirably is provided by way of non-limiting example in an upper end 622.

The housing 614 includes front and back walls 628, 630 and upper and lower ends 622, 634. Sidewalls 636 cooperate with the walls 628, 630 and ends 622, 634 to provide compartment 618 and closure to the housing 614. Desirably, but not by way of limitation, the housing 614 may be formed to generally conform to a certain amount of dry sheets 12 provided in the housing 614. In the present embodiment, the dry sheets 12 as a group have a generally polygonal shape. Similarly, by way of non-limiting example, the housing 614 may have a polygonal shape as well.

The dispenser 610 is used to dispense dry sheets 12 from a generally horizontal surface 48, such as, for example, a table top, and so forth. When the dispenser 610 is positioned on such a horizontal surface 48, the structure, namely the wall or end having the dispensing opening 620 therein, such as the upper end 622, is desirably disposed in a superior or higher position, as shown in FIG. 19. It will be appreciated, however, that any position may be used to dispense dry sheets 12, such as tissue sheets used as facial tissue, and so forth, from a horizontal surface 48 such as a table top. However, as often occurs in a bathroom, it is desirable to have a dispenser 610 which is suitable for dispensing dry sheets 12 for use as bath or toilet tissue. The dispenser 610 easily adapts to this task, converting from a table top dispenser to a dispenser which couples to a conventional rolled product fixture for dispensing sheets for use as bath or toilet tissue.

As shown in FIGS. 19 and 20, the dispenser 610 desirably includes a sling 650 which is attached near an edge of the lower end 634. The sling 650 is coupled to or integrally formed with at least a portion of the lower end 634 of the housing 614; this position is by example and not by way of limitation. The sling 650 is overlapped and positioned against a portion of the lower end 634 and the back wall 630 of the housing 614 and held in place by a removable adhesive seal 52 when the dispenser 610 is positioned for use on a horizontal surface 48 for dispensing dry sheets 12 as facial tissue, and so forth. This position masks the sling 650 against the housing 614 and hides the purpose of the sling 650. When the dispenser 610 is desired for use as a dispenser for bath tissue, the seal 52 is removed, and the sling 650 is extended and ready to be positioned on a roll mount 54 of a conventional rolled product fixture 56.

The dispenser 610 shown in FIG. 19 is rotated in a direction 658 and the roll mount 54 is positioned through the sling 650; the roll mount 54 is releasably coupled to the fixture 56, as illustrated in FIG. 20. The fixture 56, including the side support arms 60 and the roll mount 54, have been described in detail previously herein. The roll mount 54 is positioned through the sling 650 so that the dispenser 610 may be releasably coupled to the roll mount 54 and the fixture 56. The sling 650, and any embodiment of the sling shown and/or described herein, may be heat sealed, adhesively sealed ultrasonically sealed, or formed integrally with itself in a loop.

When the housing 614 is suspended from the roll mount 54, the housing 614 is positioned such that it is positioned at an oblique angle relative to the vertical support surface 62 (FIG. 20). The upper end 632 and the dispensing opening 620 therein are positioned in an inferior or lower position as compared to its previous position of dispensing dry sheets 12 from the top of the dispenser 610. The upper end 632 is positioned in a front position so that the dry sheets 12 are dispensed from a front 699 of the dispenser 610 when it is coupled to the roll mount 54.

The housing 614, particularly the sling 650 and the upper portion 671 of the housing 614, has a width dimension 670 which corresponds to less than the width dimension 68 between support arms 60 (FIG. 2). The housing 614 also has a length dimension 680 which extends from the upper end 622 to the lower end 634. The housing 614 also has a depth dimension 681 which extends from the front wall 628 to the back wall 630.

A first axis 677 along a midpoint of a sidewall 636 is illustrates the oblique angle of the housing 414 when coupled to a roll mount 54 relative to a second axis 697 which is a vertical axis of the substantially vertical support surface 62. In this manner, the housing 614 is positioned to tilt toward a user.

The housing 614 may desirably be non-refillable, and when the dry sheets 12 are removed, the dispenser 610 is disposed of. However, the housing 614 may be refillable. It refillable, the housing 614 will open along the junction of the edges (not shown). At least a portion of the edges may be connected by hinges, such as living hinges, fasteners, latches, and so forth, to permit access and closure to the compartment.

If the dispenser 610 permits refilling, a plurality of dry sheets 12 are disposed in the compartment 618 of the housing 614. In this instance, the dry sheets 12 may be provided in a cartridge of sheets (not shown). Such a cartridge is formed about at least a portion of the dry sheets to couple a plurality of dry sheets 12 together. The cartridge may be a band, or may provide a housing (not shown). In this situation, an opening is provided in at least one surface of the cartridge which desirably aligns with a dispensing opening in the housing, to permit dispensing of the sheets therefrom (not shown). In addition, it will be appreciated that the dispenser 610 and the housing 614 may include any features and/or characteristics shown and/or described herein for any dispenser and housing.

In another embodiment of the invention, as illustrated in FIGS. 21, 22 and 24, the dispenser 710 and housing 714 are very similar to the dispenser 610 and the housing 614 shown in FIGS. 19, 20 and 23, and previously described in detail herein. The dispenser 710, however, is adapted to provide premoistened sheets 111 as well as dry sheets 12 from a single housing 714. The compartment 718 (FIG. 24) contains a plurality of dry sheets 12. The compartment 718 also includes a container 119 of premoistened sheets 111 as well. The container 119 of premoistened sheets 111, as illustrated, may be provided as a separate container 119. Alternatively, however, the container 119 of premoistened sheets 111 may be provided as a portion of a cartridge which includes dry sheets 12 (not shown).

The housing 710, similar to the housing 610, includes front and back walls 728, 730 and upper and lower ends 722, 734. Sidewalls 736 cooperate with the walls 728, 730 and ends 722, 734 to provide closure and a compartment 718 in the housing 714. Desirably, but not by way of limitation, the housing 714 may be formed to generally conform to a certain amount of dry sheets 12 and premoistened sheets 111. In the present embodiment, the dry sheets 12 and the container 119 of premoistened sheets 111 may together have a generally polygonal shape.

The premoistened sheets 111 are dispensed from the container 119 from an opening (not shown) in the container 119 and through a dispensing opening (not shown) in the housing 714. The dry sheets 12 are dispensed from the dispensing opening 720 in the upper end 722 of the housing 714, as illustrated in FIG. 21.

As shown in FIGS. 21 and 22, a resealable cover 182 may be positioned on the back wall 730 over the dispensing opening (not shown) in the housing 714 which is aligned with the opening (not shown) in the container 119 of premoistened sheets 111. The premoistened sheets 111 are then accessed through the resealable cover 182 to permit dispensing of the premoistened sheets 111 from the dispenser 710. Alternatively, or, in addition thereto, the container 119 may also include a resealable cover 182 which is aligned with the dispensing opening of the housing 714 to permit access to the premoistened sheets 119 as well (not shown).

The resealable cover 182 is used to maintain the moisture conditions within the container 119 and to prevent undesired drying out of the premoistened sheets 111. In a non-limiting example of one possible resealable cover 182, FIG. 22 discloses a resealabe cover 182 which includes an upper flap 184 which is coupled to a portion of a lower flap 186, which has an opening or slit 188 opening therein, through which the premoistened sheets 111 are withdrawn. The upper flap 184 releasably engages the lower flap 186 to provide a releasable closure to the housing 714 and the container 119. Such releasable and resealable features between the upper and lower flaps 184, 186 is provided, by way of non-limiting example, an adhesive, such as a pressure sensitive adhesive, a cohesive adhesive, such as a latex or other natural rubber material, and so forth. Other resealable mechanisms, such as, by way of non-limiting example, snap-fit, hinged cover and lid, and so forth are known and may be used; any resealable mechanism known in the art may be used with any dispensing opening in the housing and/or any opening in the container.

As illustrated in FIG. 24, the housing 714 desirably is an integral unit such that one compartment contains the dry sheets 12 and the container 119 of premoistened sheets 111. However, alternatively, the housing 714 may include first and second compartments formed separately such that one compartment holds dry sheets and another compartment holds the container of premoistened sheets (not shown). Such compartments may be delineated by separate cartridges or containers, or, by way of non-limiting example, the housing may have at least a portion of an inner wall (not shown) in which to provide first and second compartments (not shown).

The premoistened sheets 111 may be encased in a liquid impermeable film, and this film may provide a portion, or all, of the container 119 as shown in FIG. 18. In a further example, the container 119 may be formed from at least one other material, and the container 119 may be lined with the film (not shown).

When the dispenser 710 is used to dispense dry sheets 12 and premoistened sheets 111 from various generally horizontal surfaces 48, the dispenser 710 may be positioned in various positions to permit access to premoistened sheets 111 or dry sheets 12. For example, as shown in FIG. 21, the dispenser is positioned such that the upper end 722 having the dispensing opening 720 therein is positioned in a superior or higher position relative to the premoistened sheets 111. Alternatively, the housing 714 may be turned a direction 793 about 90 degrees such that the back wall 730 and the resealable cover 182 from which the premoistened sheets 111 are dispensed is now disposed in a superior or higher position relative to the dry sheets 12 (not shown). It will be appreciated that these positions create no detrimental effects to the dispenser 710 or the premoistened sheets 111 or dry sheets 12. Either of these positions permit dispensing of dry sheets 12 or premoistened sheets 111 for use, for example, as facial tissue sheets, wet wiping sheets, and so forth. However, as often occurs in a bathroom, it is desirable to have a dispenser 710 which is suitable for dispensing dry sheets 12 for use as bath or toilet tissue as well as premoistened sheets 111. The dispenser 710 easily adapts to this task, converting from a table top dispenser to a dispenser which couples to a conventional rolled product fixture for dispensing sheets for use as bath or toilet tissue.

The dispenser 710, as shown in FIG. 21, has a sling 750 which is attached to a portion of the housing 714, in this embodiment, to the lower end 734 of the housing 714. The sling 750 is overlapped and positioned against the housing 714 and held adhesively in place and/or is held in place by a removable adhesive seal (not shown), and so forth, when the dispenser 710 is positioned for use on a horizontal surface 48 for dispensing facial tissue, wet sheets, and so forth. When the dispenser 710 is desired for use as bath tissue, the seal is removed, and the sling 750 is expanded and ready to be positioned on a roll mount 54 of a conventional bath tissue fixture 56 which traditionally holds a roll or toilet tissue.

When the housing 714 is suspended from the roll mount 54, the housing 714 may be positioned at an oblique angle with respect to adjacent vertical support surface 62. In this position, the back wall 730 having the premoistened sheets 111 dispensed through the resealable cover 182 are positioned in a superior or higher position and near the sling 550 and the roll mount 54, and the upper end 722 having the dispensing opening 720 through which dry sheets 12 are dispensed is positioned in an inferior or lower position in front 799.

The dispenser 710 and the housing 714 include width, length, and depth dimensions. These dimensions are the same as those previously shown and/or described for dispenser 610 and housing 614. In addition, it will be appreciated that the dispenser 710 and the housing 714 may include any features and/or characteristics shown and/or described herein for any dispenser and housing.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A non-refillable dispenser adapted for dispensing from a table top and convertible to dispensing from a conventional rolled product fixture, the non-refillable dispenser comprising:

a housing having a compartment configured to hold sheets therein and a dispensing opening, the housing configured to be positioned on a table top for dispensing sheets therefrom, the housing including connecting means including a sling which permits the housing to be coupled to a fixture, the connecting means masked as a portion of the housing and the sling folded down and held against the housing by one of adhesive on the sling, a seal, and a combination thereof when the housing is positioned on a table top for dispensing therefrom, the connecting means readily releasable to permit the housing to be coupled to a fixture.

2. The non-refillable dispenser of claim 1 wherein the housing when coupled to a fixture is disposed at an oblique angle and positioned such that a first axis extends vertically through a highest point of the housing and a lowest point of the housing, the housing positioned such that a second axis extends horizontally through a depth dimension of the housing, the sheets dispensing through the dispensing opening on a third axis which is positioned between the first and second axis.

3. The non-refillable dispenser of claim 2 wherein the housing is configured to be disposed diagonally relative to a fixture.

4. The non-refillable dispenser of claim 1, wherein the housing is configured to be positioned substantially parallel to a vertical support surface when coupled to a fixture.

5. The non-refillable dispenser of claim 1, wherein the sling is positioned along a midline of an end of the housing and extends in a loop therefrom when coupled to a fixture.

6. The non-refillable dispenser of claim 1, wherein the sling is positioned to extend from an edge of a portion of the housing, and the housing is positioned at an oblique angle when the sling is coupled to a fixture.

7. The non-refillable dispenser of claim 1, wherein at least an upper portion of the housing has a width dimension which is less than a width dimension between support arms of a fixture.

8. The non-refillable dispenser of claim 1, wherein the sheets include dry sheets.

9. The non-refillable dispenser of claim 8, wherein the dry sheets are toilet tissue.

10. The non-refillable dispenser of claim 1, wherein the sheets include dry sheets and premoistened sheets.

11. The non-refillable dispenser of claim 10, wherein the sling includes an opening to permit access to the premoistened sheets.

12. The non-refillable dispenser of claim 1, wherein the housing includes a resealable cover.

13. The non-refillable dispenser of claim 1, wherein the housing is constructed from paper, paperboard, cardboard, plastic, polymer film, cellophane, and any combination thereof.

14. A dispenser adapted for dispensing from a table top and convertible to dispensing from a conventional rolled product fixture, the dispenser comprising:

a housing having a compartment configured to hold sheets therein and a dispensing opening, the housing configured to be positioned on a table top for dispensing sheets therefrom, the housing including a sling which permits the housing to be coupled to a fixture, the sling masked as a portion of the housing and the sling folded down and held against the housing by one of adhesive on the sling, a seal, and a combination thereof when the housing is positioned on a table top for dispensing therefrom, the sling readily releasable to permit the housing to be releasably coupled to a fixture in a bathroom.

15. The dispenser of claim 14 wherein the housing when coupled to a fixture is disposed at an oblique angle and positioned such that a first axis extends vertically through a highest point of the housing and a lowest point of the housing, the housing positioned such that a second axis extends horizontally through a depth dimension of the housing, the sheets dispensing through the dispensing opening on a third axis which is positioned between the first axis and the second axis.

16. The dispenser of claim 15 wherein the housing is configured to be disposed diagonally relative to a fixture.

17. The non-refillable dispenser of claim 14, wherein the housing is configured to be positioned substantially parallel to a vertical support surface when coupled to a fixture.

18. The dispenser of claim 14, wherein the sling is positioned along a midline of an end of the housing and extends in a loop therefrom when coupled to a fixture.

19. The dispenser of claim 14, wherein the sling is positioned to extend from an edge of a portion of the housing, and the housing is positioned at an oblique angle when the sling is coupled to a fixture.

20. The dispenser of claim 14, wherein at least an upper portion of the housing has a width dimension which is less than a width dimension between support arms of a fixture.

21. The dispenser of claim 14, wherein the sheets include dry sheets.

22. The dispenser of claim 21, wherein the dry sheets are toilet tissue.

23. The dispenser of claim 14, wherein the sheets include dry sheets and premoistened sheets.

24. The dispenser of claim 23, wherein the sling includes an opening to permit access to the premoistened sheets.

25. The dispenser of claim 14, wherein the housing includes a resealable cover.

26. The dispenser of claim 14, wherein the housing is constructed from paper, paperboard, cardboard, plastic, polymer film, cellophane, and any combination thereof.

27. A dispenser adapted for dispensing from a table top and convertible to dispensing from a conventional rolled product fixture in a bathroom, the dispenser comprising:

a housing having a compartment configured to hold dry sheets and premoistened sheets therein and a dispensing openings positioned to permit the dry sheets and the premoistened sheets to be dispensed therefrom, the housing configured to be positioned on a table top for dispensing sheets therefrom, the housing including sling which permit the housing to be coupled to a fixture, the sling masked as a portion of the housing and the sling folded down and held against the housing by one of adhesive on the sling, a seal, and a combination thereof when the housing is positioned on a table top for dispensing therefrom, the sling readily releasable and the housing configured to dispense from an upper end or a lower end when the housing is coupled to a fixture in a bathroom.

28. The dispenser of claim 27, wherein the housing when coupled to a fixture is disposed at an oblique angle and positioned such that a first axis extends vertically through a highest point of the housing and a lowest point of the housing, the housing positioned such that a second axis extends horizontally through a depth dimension of the housing, the sheets dispensing through the dispensing opening on a third axis which is positioned between the first axis and the second axis.

29. The dispenser of claim 28, wherein the housing is configured to be disposed diagonally relative to a fixture.

30. The dispenser of claim 27, wherein the housing is configured to be positioned substantially parallel to a vertical support surface when coupled to a fixture.

31. The dispenser of claim 27, wherein the sling is positioned along a midline of an end of the housing and extends in a loop therefrom when coupled to a fixture.

32. The dispenser of claim 27, wherein the sling is positioned to extend from an edge of a portion of the housing, and the housing is positioned at an oblique angle relative to a vertical support surface when the sling is coupled to a fixture.

33. The dispenser of claim 27, wherein at least an upper portion of the housing has a width dimension which is less than a width dimension between support arms of a fixture.

34. The dispenser of claim 27, wherein the dry sheets are toilet tissue.

35. The dispenser of claim 27, wherein the sling includes an opening to permit access to the premoistened sheets.

36. The dispenser of claim 27, wherein the housing includes a resealable cover.

37. The dispenser of claim 27, wherein the housing is constructed from paper, paperboard, cardboard, plastic, polymer film, cellophane, and any combination thereof.

* * * * *